US008281846B2

(12) United States Patent
Zhu

(10) Patent No.: US 8,281,846 B2
(45) Date of Patent: Oct. 9, 2012

(54) CURTAIN

(76) Inventor: Xiangrong Zhu, Flatad-Tongnamahjardim (MO)

( * ) Notice: Subject to any disclaimer, the term of this patent is extended or adjusted under 35 U.S.C. 154(b) by 17 days.

(21) Appl. No.: 12/738,993

(22) PCT Filed: Jun. 17, 2008

(86) PCT No.: PCT/CN2008/001174

§ 371 (c)(1),
(2), (4) Date: Apr. 21, 2010

(87) PCT Pub. No.: WO2009/052693

PCT Pub. Date: Apr. 30, 2009

(65) Prior Publication Data

US 2010/0314054 A1 Dec. 16, 2010

(30) Foreign Application Priority Data

Oct. 24, 2007 (CN) ..... 2007 1 0092909
Oct. 24, 2007 (CN) ..... 2007 1 0092910
Jan. 2, 2008 (CN) ..... 2008 1 0069214
Mar. 17, 2008 (CN) ..... 2008 1 0026817

(51) Int. Cl.
*A47G 5/02* (2006.01)

(52) U.S. Cl. ..... 160/319; 160/308; 160/168.1 R

(58) Field of Classification Search ..... 160/319, 160/320, 193, 168.1 R, 297, 296, 302, 304.1, 160/305, 307, 308, 84.04
See application file for complete search history.

(56) References Cited

U.S. PATENT DOCUMENTS 4,250,942 A * 2/1981 Dreher et al. ..... 160/297
4,513,805 A 4/1985 Mase ..... 160/299
4,519,487 A * 5/1985 Florin ..... 192/36
5,566,741 A * 10/1996 Ogawara et al. ..... 160/297
5,890,529 A * 4/1999 Haarer ..... 160/319
6,129,131 A * 10/2000 Colson ..... 160/84.02
7,549,458 B2 * 6/2009 Kwak ..... 160/319
7,665,507 B2 * 2/2010 Naoki ..... 160/308
8,186,413 B2 * 5/2012 Fujita et al. ..... 160/121.1
8,191,605 B2 * 6/2012 Kwak ..... 160/319
2004/0261958 A1 * 12/2004 Sugiyama et al. ..... 160/296
2006/0272783 A1 * 12/2006 Smith et al. ..... 160/121.1
2009/0308547 A1 * 12/2009 Kwak ..... 160/368.1
2010/0314054 A1 * 12/2010 Zhu ..... 160/294
2011/0209836 A1 * 9/2011 Yu et al. ..... 160/305

FOREIGN PATENT DOCUMENTS

CN 2251321 4/1997

(Continued)

*Primary Examiner* — Blair M. Johnson

(74) *Attorney, Agent, or Firm* — Alan Kamrath; Kamrath IP Lawfirm, PA

(57) ABSTRACT

A curtain includes a curtain bracket (1) having an end to which a rotation driving device (3) is mounted. The rotation driving device (3) can actuate a curtain reeling drum (4A) to rotate a curtain cloth (7) or actuate a reeling rope device (4) to rotate a curtain cloth or shade (7). A reverse rotation releasing device (5) and a resilience reverse rotation mechanism (14) are connected to the rotation driving device (3). The rotation driving device (3) is comprised of a pull rope rotary disc (3*c*), a unidirectional clutch device (6) connected to the pull rope rotary disc (3*c*), and a rewinding spring (3*e*) mounted between the pull rope rotary disc (3*c*) and a pull rope rotary disc box (3*a*). Thus, only one cord is sufficient to control opening of the curtain cloth or shade (7), and reverse rotation of the curtain reel drum (4A) is not adversely affected by the rotation driving device (3). It is convenient to use while avoiding injury to children.

39 Claims, 15 Drawing Sheets

FOREIGN PATENT DOCUMENTS

| | | | |
|---|---|---|---|
| CN | 2725495 | | 9/2005 |
| CN | 1025073 | | 8/2007 |
| CN | 1139910 | | 3/2008 |
| CN | 1106396 | | 8/2008 |
| GB | 2466174 | * | 4/2009 |
| WO | WO2006133639 | | 12/2006 |

* cited by examiner

CURTAIN

FIELD OF THE INVENTION

The present invention relates to a curtain.

BACKGROUND OF THE INVENTION

Curtains in the prior art that move a curtain cloth or shade vertically by a reeling rope or a reeling drum are generally comprised of a curtain bracket, a rotation driving device mounted on the curtain bracket, and a reeling rope device or a reeling drum mounted on the curtain bracket and driven by the rotation driving device. Some of the curtains are further provided with a speed reducing device to prevent the transmission members from being damaged as a result of a rapid fall of the curtain cloth or shade. The rotation driving device of the curtains is operated either by an endless bead chain (pull rope) or by a pull rope wound inside the reeling drum to wind or release the curtain. However, when it is manipulated by the endless bead chain (pull rope), a U-shaped rope loop will be formed by the hanging endless bead chain (pull rope), and a child playing around may be strangled when the child accidentally puts his or her neck into the rope loop. Manipulation through the pull rope wound inside the reeling drum needs to draw out a section of the cord to a length the same as that of the curtain cloth or the shade. The redundant length of the rope not only affects the curtain operation but also is easily entangled, such that it is impossible to handle the curtain. In order to solve these problems, technology, disclosed in China Patent Publication No. CN101025073 was developed, of the type comprised of a box, a rotary wheel rotatably mounted in the box, a rotary shaft connected to the rotary wheel for rotating a reeling drum, and a pull rope rotary wheel rotatably connected to the rotary wheel. A spring groove is formed in the pull rope rotary wheel. A spring is provided in the spring groove with an end of the spring connected to the pull rope rotary wheel and with the other end of the spring connected to the box. One or more ball recesses are transversely formed in an axial hole of the pull rope rotary wheel for rotational connection with the rotary wheel. Annular guide channels are formed in an exterior surface of the rotary wheel. One or more recesses are formed in a lateral side of the annular guide channels and project beyond the annular guide channels. Guiding grooves are provided between the annular guide channels and the ball recesses. Balls are arranged between the annular guide channels and the ball recesses, and a pull rope is wound around the exterior surface of the pull rope rotary wheel. In operation, the pull rope is drawn to rotate the pull rope rotary wheel which simultaneously winds up the spring and drives the balls to move along the annular guide channels in the exterior surface of the rotary wheel. When the balls enter the recesses at the lateral side of the annular guide channels, the rotary wheel rotates and drives the reeling drum to release the curtain. When the pull rope reaches its end, the pull rope is released to reversely rotate the pull rope rotary wheel under the resilient force of the spring and rewind the pull rope back to the pull rope rotary wheel. During reverse rotation of the pull rope rotary wheel, the balls can only move along the annular guide channels since they cannot enter the recesses at the lateral side of the annular guide channels, such that the rotary wheel will not rotate together with the reversely rotating pull rope rotary wheel. In such a way, the curtain can be fully opened by the reeling drum through continuously drawing and releasing of the pull rope. Since only one cord is provided, the risk of strangling a playful child by the neck is avoided, providing enhanced safety. However, the rotary wheel must reversely rotate together with the reeling drum to reel the curtain onto the reeling drum. Limited by the structure, the pull rope rotary wheel usually has a relatively large diameter, and the volume of the reeling drum driving device is restricted by the environment using the curtain, such that the pull rope rotary wheel cannot conceal a long cord. Furthermore, smooth reverse rotation of the reeling drum is adversely affected, because the reversely rotating reeling drum is inevitably influenced by the resistance of the rotary wheel that rotates jointly with the reeling drum. Furthermore, such a curtain has a single function, since it only can be utilized with curtain cloths or shades of a certain type.

SUMMARY OF THE INVENTION

It is an object of the present invention to provide a curtain that can be used safely and conveniently. The curtain has a pull rope rotary disc capable of concealing a relatively long section of pull rope to avoid exposure of an excessive rope section such that reverse rotation of the curtain reeling drum will not be adversely affected by the pull rope drive mechanism.

The curtain of the present invention is comprised of a curtain bracket, a rotation driving device mounted to an end of the curtain bracket, a curtain reeling drum or a reeling rope device driven by the rotation driving device, a curtain cloth driven by the curtain reeling drum or a curtain cloth or shade driven by a reeling rope of the reeling rope device, and a reverse rotation releasing device connected to the rotation driving device. The rotation driving device is comprised of a pull rope rotary disc box fixed to the curtain bracket, a pull rope rotary disc rotatably mounted in the pull rope rotary disc box and wound with a pull rope, and a unidirectional clutch device connected to the pull rope rotary disc. A rewinding spring is mounted between the pull rope rotary disc and the pull rope rotary disc box. The unidirectional clutch device is comprised of an axial hole connected to the pull rope rotary disc box, a rotary shaft mounted in the axial hole for driving the curtain reeling drum or the reeling rope device, and a clutch sliding rotary head located on one end of the rotary shaft. Teeth for unidirectional engagement are arranged on end surfaces where the rotary shaft and the clutch sliding rotary head are connected. A jacket is mounted to a side of the pull rope rotary disc. An inclined slot is formed in an exterior surface of the other end of the clutch sliding rotary head. A slider is mounted in the jacket at the side of the pull rope rotary disc corresponding to the inclined slot. A spring coil is connected between the exterior surface of the clutch sliding rotary head and the axial hole.

In operation, the pull rope is drawn downwardly to drive the pull rope rotary disc to rotate. The pull rope rotary disc is rotated together with the jacket and the slider. Due to a certain static friction between the spring coil and the exterior surface of the clutch sliding rotary head as well as the axial hole (which static friction is larger than the friction between the slider and the inclined slot), the slider is moved along the inclined slot to push the clutch sliding rotary head to move towards the rotary shaft with its end face engaged with the end surface of the rotary shaft. In such a way, the clutch sliding rotary head drives the rotary shaft to rotate and, in turn, the rotary shaft drives a transmission shaft to thereby drive the reeling rope device for reeling the rope, or drives the transmission shaft to rotate such that the curtain cloth or the shade is reeled or unreeled. When releasing the pull rope, the pull rope rotary disc is rotated reversely by the rewinding spring to reel the pull rope back to the pull rope rotary disc. At the same time, the jacket and the slider driven by the pull rope rotary disc are rotated reversely so that the slider is reversely moved along the inclined slot and pushes the clutch sliding rotary head to move away the rotary shaft under the action of a pressure spring with its end face disengaged from the end surface of the rotary shaft. Thus, the rotary shaft is in a free state and cannot be rotated reversely under the action of the reverse rotation releasing device. The rotary shaft can be rotated reversely only when the reverse rotation releasing device is activated for a short period of time, and the curtain cloth or the shade is opened under the action of the gravity acting on the curtain cloth or the shade or the curtain cloth is reeled by a resilience reverse rotation mechanism to thereby retract the curtain cloth. Since the rotary wheel required in the prior art has been omitted, a relatively larger rewinding spring can be utilized to conceal a longer pull rope section while using the pull rope rotary disc of the same diameter.

The pressure spring is mounted between the rotary shaft and the clutch sliding rotary head. The pressure spring assures the slider to push the clutch sliding rotary head to move away from the rotary shaft with the end face of the clutch sliding rotary head disengaged from the rotary shaft under the action of the pressure spring when the slider is reversely moved along the inclined slot, to enable the rotary shaft to be in a free state and smoothly rotate with the curtain reeling drum.

Herein, an exterior surface of the spring coil abuts against an interior wall of the axial hole. A longitudinally extending groove is formed in an exterior wall of the clutch sliding rotary head and receives an end of the spring coil. In operation, due to the static friction between the spring coil and the axial hole (which static friction is larger than the friction between the slider and the inclined slot) and due to the end of the spring coil being restrained by the longitudinally extending groove in the exterior wall of the clutch sliding rotary head, the spring coil is not rotatable relative to the clutch sliding rotary head but is movable without any resistance in the longitudinal direction of the groove to thereby move the slider along the inclined slot such that the clutch sliding rotary head is pushed towards the rotary shaft with its end face engaged with the end face of the rotary shaft. In such a way, the clutch sliding rotary head drives the rotary shaft to rotate together with the curtain reeling drum. In order not to increase the dynamic friction between the spring coil and the axial hole when the clutch sliding rotary head drives the rotary shaft to rotate, the spring coil preferably has a fewer number of coils. The spring winding direction of the spring coil is the same as the rotation direction of the clutch sliding rotary head when driving the rotation shaft to rotate. In such a way, when the clutch sliding rotary head drives the rotary shaft to rotate, the end of the spring coil located in the groove drives the spring coil to rotate. Since the spring winding direction of the spring coil is the same as the rotation direction of the rotary shaft driven by the clutch sliding rotary head, the diameter of the spring coil is increased to make the spring coil firmly against the interior wall of the axial hole when the clutch sliding rotary head drives the spring coil to rotate via the end of the spring coil located inside the groove, such that the dynamic friction between the spring coil and the axial hole remains unchanged. During reverse rotation, the diameter of the spring coil is reduced as a result of the reverse rotation of the spring coil by the rewinding spring to thereby reduce the friction between the coil and the axial hole. Accordingly, the spring coil is preferably configured to have a relatively small resilience to avoid an increase in the pulling force for the pull rope and the adverse influence upon the comfort while using the product.

The reverse rotation releasing device is comprised of a sleeve and a sleeve shaft mounted in the sleeve and connected to the curtain bracket. An interior side wall of the sleeve is provided with a guide groove. A continuous sliding path is formed along the surface of the sleeve shaft. A ball is mounted between the guide groove and the sliding path. The sliding path is comprised of one or more groups of left and right sliding paths and an intermediate V-shaped sliding path. In a direction of the left sliding path and the intermediate sliding path, there are guiding mouths for respective directions to the right sliding path and the left sliding path. In another direction of the right sliding path, there is a guide mouth for a direction to the intermediate V-shaped sliding path. In operation, the sleeve shaft rotates together with the rotary shaft. The ball is moved along the guiding groove and the sliding path. When the sleeve shaft rotates in a direction allowing the ball to enter the right sliding path, the sleeve shaft is smoothly rotated to rotate the transmission shaft to thereby close the curtain. When the sleeve shaft stops rotating, the sleeve shaft is slightly rotated reversely under the action of the gravity acting on the curtain cloth or the shade to allow the ball to enter the intermediate V-shaped sliding path and to be trapped therein via the guide mouth. Thus, the sleeve shaft is unable to be rotated reversely, and the curtain cloth or the shade is unable to be released, until the sleeve shaft is rotated through a small angle in the direction retracting the curtain cloth, such that the ball is allowed to pass through the guiding mouth from the intermediate V-shaped sliding path and into the left sliding path and, thus, no longer trapped in the intermediate V-shaped sliding path. Accordingly, the sleeve shaft is rotated reversely by the transmission shaft which is driven by the gravity acting on the curtain cloth or the shade to open the curtain. The reverse rotation releasing device is connected to the unidirectional clutch device, and both of them are arranged on one end of the curtain bracket such that devices of other functions can be advantageously arranged on the other end of the curtain bracket.

In order to reduce the free falling speed of the curtain cloth or shade to thereby avoid adverse influence upon the entire device, the curtain bracket is provided with a speed reducing device connected to the transmission shaft. The speed reducing device is comprised of a box body, a speed shifting mechanism mounted in the box body and connected to the transmission shaft, and a frictional speed reducing mechanism driven by the speed shifting mechanism. The speed shifting mechanism is comprised of a gear or a gear train, and a worm engaged with the gear or an output gear of the gear train. Output shafts of the worm are mounted in the box body via bearings. One of the output shafts of the worm is connected to the frictional speed reducing mechanism. The frictional speed reducing mechanism is comprised of a rotary base, a friction block swingingly connected to the rotary base, and a circular chamber formed in the box body. The friction block is positioned in the circular chamber. In order to enhance the frictional speed reducing effect, the output shafts at both ends of the worm are connected to the frictional speed reducing mechanism. The bearing is a steel ball mounted between an axial hole and the output shaft on the worm.

The speed reducing device, the reverse rotation releasing device and the rotation driving device are securely coupled together. The gear or the gear train of the speed reducing device, the sleeve shaft of the reverse rotation releasing device, and the rotary shaft of the rotation driving device are coupled together by the transmission shaft.

In comparison with the prior art, the present invention has advantages of safety and convenience as well as the use with various kinds of curtain cloths or shades without exposure of an excessive pull rope section.

PREFERRED EMBODIMENTS FOR CARRYING OUT THE INVENTION

The present invention is hereinafter further illustrated in detail by reference to the drawings and the embodiments.

Embodiment 1

Figure 1:
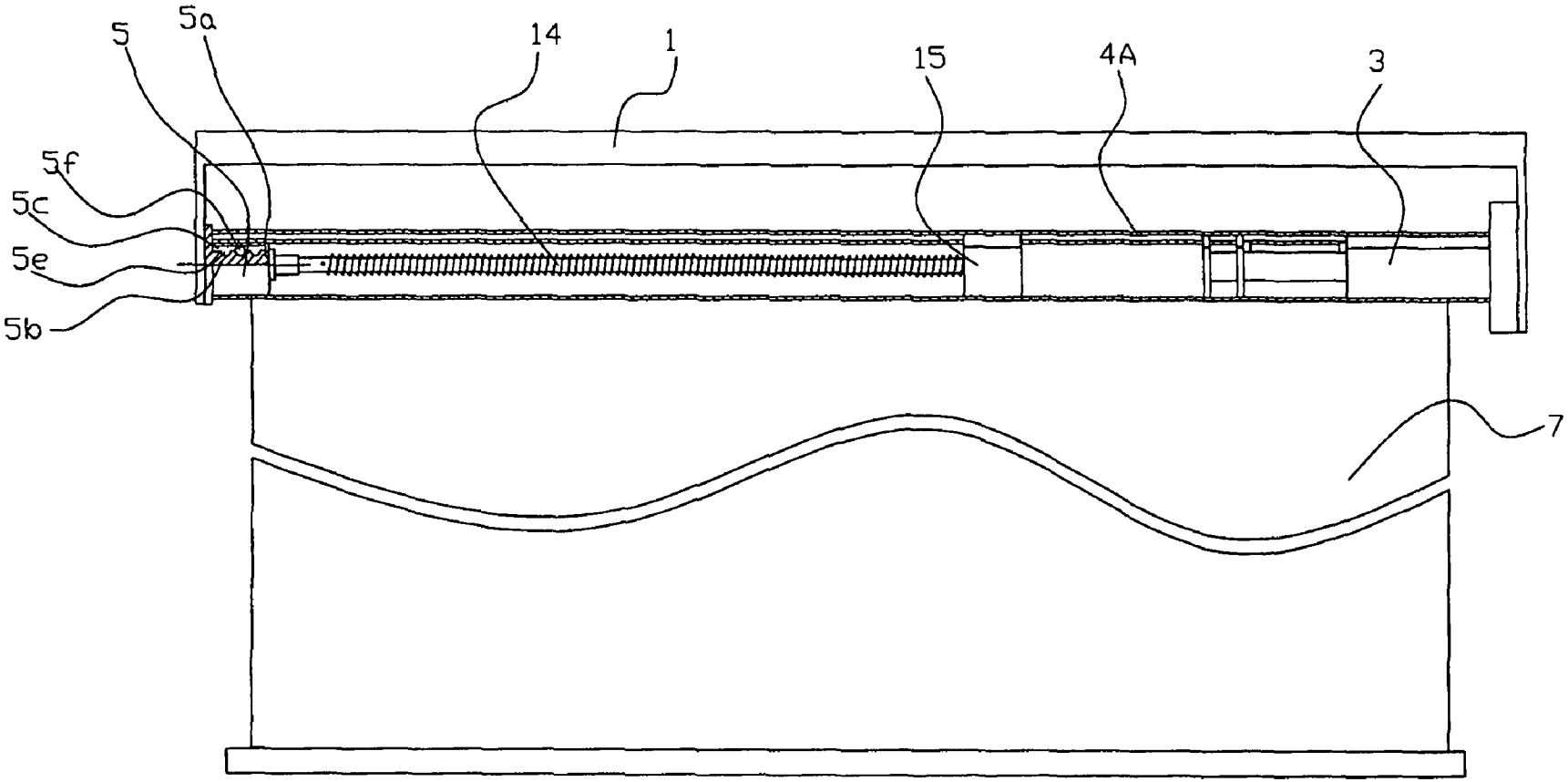
FIG. 1 is a schematic view showing structure of a first embodiment of the present invention.
Figure 2:
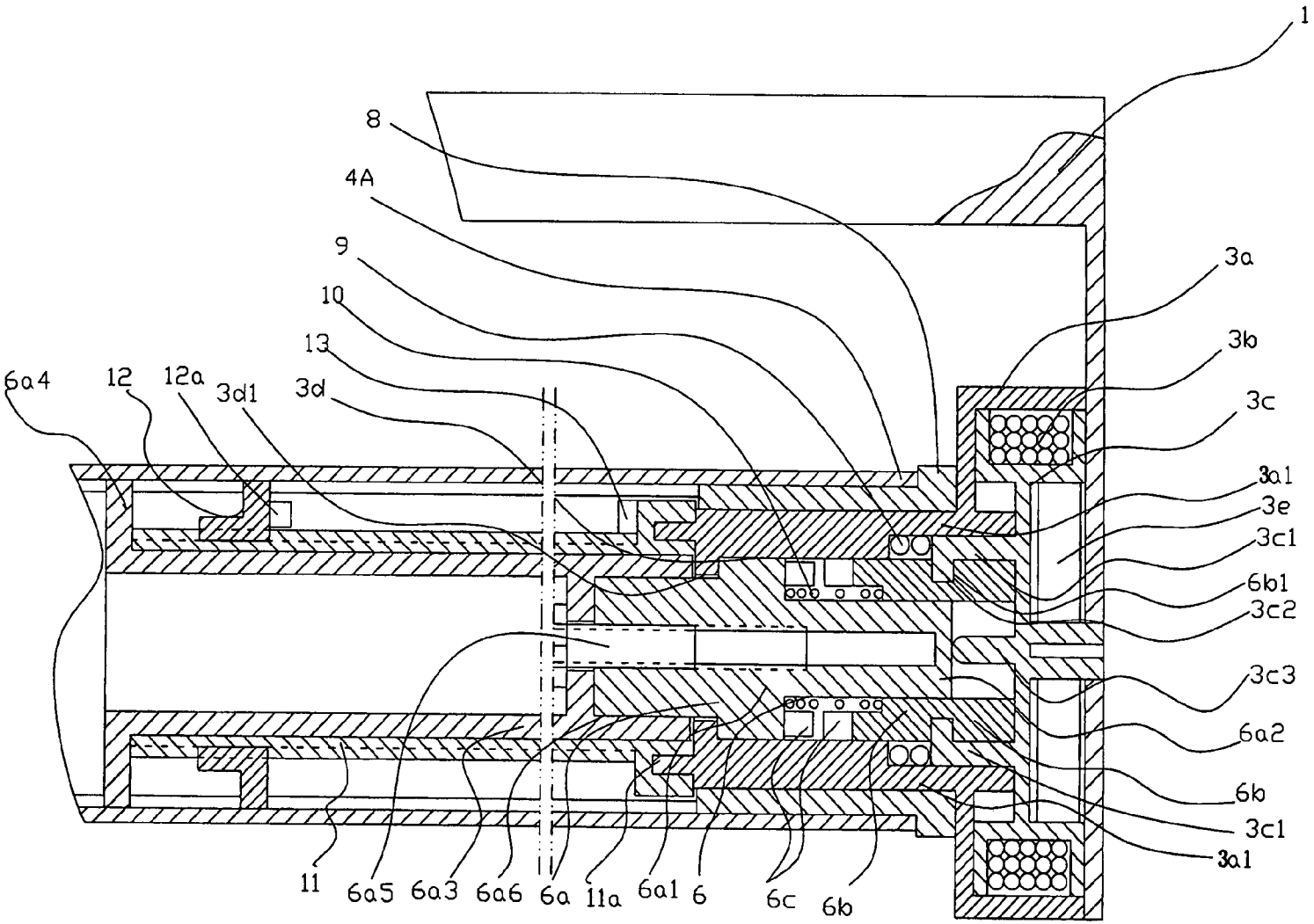
FIG. 2 is a schematic view showing structure of a rotation drive device of FIG. 1.
Figure 7:
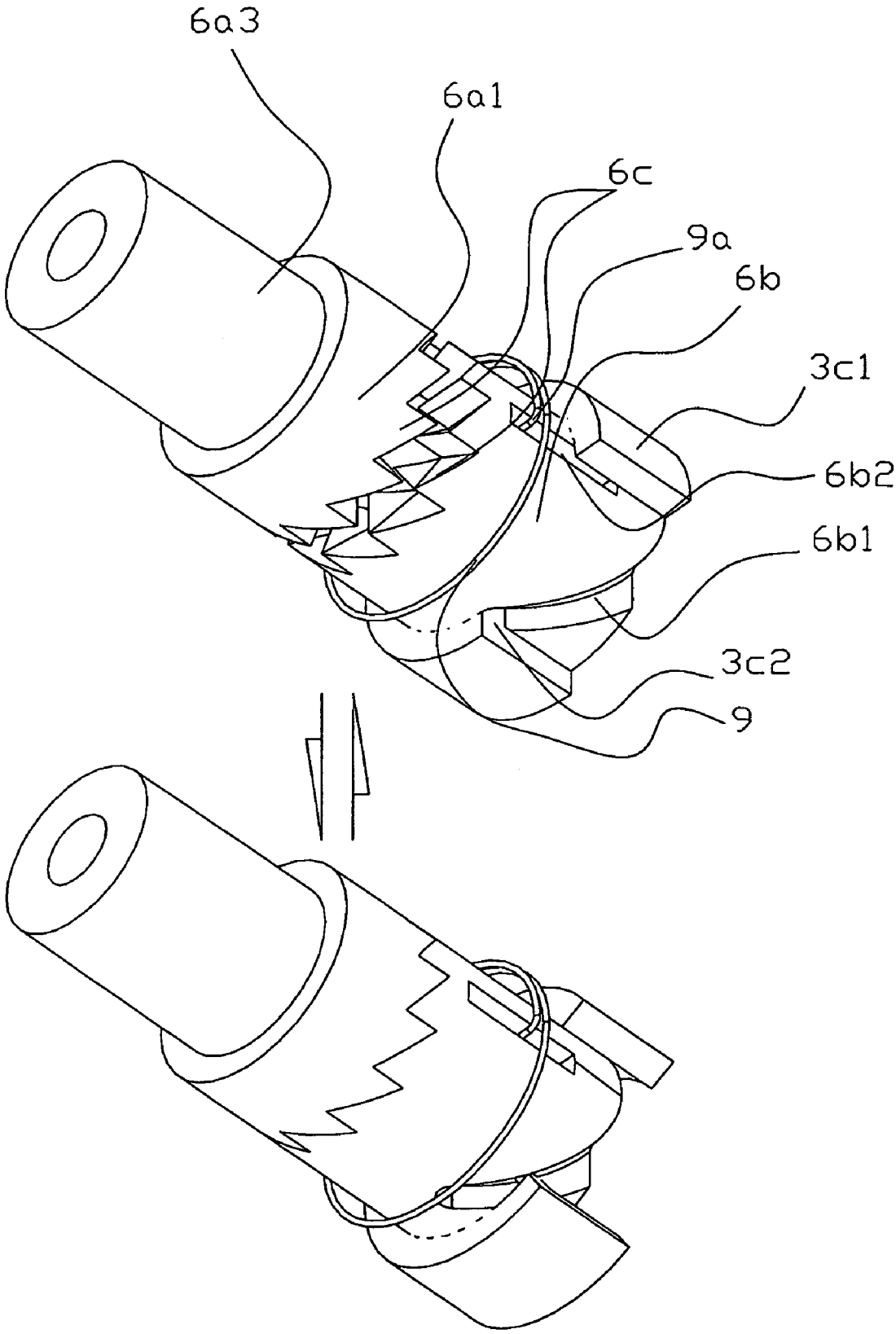
FIG. 7 is a schematic view showing structure of an exterior surface of a clutch sliding rotary head.

The curtain of the present invention is comprised of a curtain bracket 1, a rotation driving device 3 mounted to an end of the curtain bracket 1, a curtain reeling drum 4A driven by the rotation driving device 3, a curtain cloth 7 driven by the curtain reeling drum 4A, a reverse rotation releasing device 5 connected to the rotation driving device 3, and a resilience reverse rotation mechanism 14, as shown in FIGS. 1, 2, and 7. The rotation driving device 3 is comprised of a pull rope rotary disc box 3*a* fixed on the curtain bracket 1, a pull rope rotary disc 3*c* rotatably mounted in the pull rope rotary disc box 3*a* and wound with a pull rope 3*b*, and a unidirectional clutch device 6 connected to the pull rope rotary disc 3*c*. A rewinding spring 3*e* is mounted between the pull rope rotary disc 3*c* and the curtain bracket 1. The curtain reeling drum 4A is rotatably mounted to a reeling drum shaft 3*a*1 of the pull rope rotary disc box 3*a* by a reeling jacket tube 8. The unidirectional clutch device 6 is comprised of a rotary shaft 6*a* coaxial to the curtain reeling drum 4A for rotating the curtain reeling drum 4A, and a clutch sliding rotary head 6*b* coaxial to the rotary shaft 6*a*. On end surfaces where the rotary shaft 6*a* is connected to the clutch sliding rotary head 6*b*, there are provided teeth 6*c* for unidirectional engagement. A pressure spring 10 is mounted between the rotary shaft 6*a* and the clutch sliding rotary head 6*b*. The pull rope rotary disc box 3*a* includes an axial hole 3*d* coaxial to the curtain reeling drum 4A. A clutch rotary shaft 6*a*1 for connecting the rotary shaft 6*a* to the clutch sliding rotary head 6*b* is located in the axial hole 3*d* together with the clutch sliding rotary head 6*b*. The other end of the clutch sliding rotary head 6*b* is located inside a jacket 3*c*1 at a side of the pull rope rotary disc 3*c*. The jacket 3*c*1 at the side of the pull rotary disc 3*c* is rotatably mounted in the axial hole 3*d*. An inclined slot 6*b*1 is formed in an exterior surface of the other end of the clutch sliding rotary head 6*b*. A slider 3*c*2 is mounted in the jacket 3*c*1 positioned at the side of the pull rope rotary disc 3*c* and corresponding to the inclined slot 6*b*1. A spring coil 9 is connected between the exterior surface of the clutch sliding rotary head 6*b* and the axial hole 3*d*. Two ends of the spring coil 9 are in close proximity to an end face of the axial hole 3*d* and an end face of the jacket 3*c*1 at the side of the pull rope rotary disc 3*c*, preventing the spring coil 9 from being axially moved during the axial movement of the clutch sliding rotary head 6*b*. The unidirectional clutch device 6 allows the rotary shaft 6*a* to be rotated jointly with the pull rope rotary disc 3*c* when the pull rope rotary disc 3*c* is rotated in a direction pulling the pull rope 3*b* downwardly. On the other hand, the unidirectional clutch device 6 also allows the rotary shaft 6*a* to be in a free state and not to be rotated jointly with the pull rope rotary disc 3*c* when the pull rope rotary disc 3*c* is rotated in the other direction rewinding the pull rope 3*b* upwardly.

A sleeve 11 with external threading is mounted in the curtain reeling drum 4A. The sleeve 11 is connected to the pull rope rotary disc box 3*a* and threadedly engaged with a positioning stopper 12. The stopper 12 has a notch to mate with a longitudinal rectilinear groove in an interior wall of the certain reeling drum 4A. The positioning stopper 12 is transversely and slideably received in the curtain reeling drum 4A and can be moved by rotating the curtain reeling drum 4A. When pulling the pull rope 3*b* downwardly until the curtain cloth 7 reaches its most extended position, the positioning stopper 12 will reach the pull rope rotary disc box 3*a* to prevent further rotation of the curtain reeling drum 4A. In order to prevent further rotation when the positioning stopper 12 reaches the pull rope rotary disc box 3*a*, a projecting stopper 12*a* is formed on a side of the positioning stopper 12, and a baffler 13 mating with the projecting stopper 12*a* is formed on the pull rope rotary disc box 3*a* or the sleeve 11. In order to prevent the reeling jacket tube 8 from axial movement, the outer diameter of an end of the sleeve 11 is larger than that of the reeling drum shaft 3*a*1. Thus, due to limitation by the end of the sleeve 11 and the pull rope rotary disc box 3*a*, the reeling jacket tube 8 located outside the reeling drum shaft 3*a*1 cannot be moved axially For easy assembly, the rotary shaft 6*a* is comprised of the clutch rotary shaft 6*a*1 and a reeling drum driving shaft 6*a*3. An end of the reeling drum driving shaft 6*a*3 is provided with a driving wheel 6*a*4 connected to the curtain reeling drum 4A. The driving wheel 6*a*4 has a notch to mate with the longitudinal rectilinear groove in the interior wall of the curtain reeling drum 4A. The sleeve 11 is mounted around the reeling drum driving shaft 6*a*3 between the driving wheel 6*a*4 and the reeling drum shaft 3*a*1 of the pull rope rotary disc box 3*a*. The reeling drum shaft 3*a*1 is connected by a connecting member 11*a* to the sleeve 11 to prevent the sleeve from being rotated together with the curtain reeling drum 4A. An inner hole of the reeling drum driving shaft 6*a*3 mounted around the clutch rotary shaft 6*a*1 is a non-circular inner hole (for example, an inner hole having a triangular or polygonal shape), and an outline of the clutch rotary shaft 6*a*1 corresponding to the inner hole is also non-circular. The reeling drum driving shaft

6a3 mounted around the clutch rotary shaft 6a1 is connected to the clutch rotary shaft 6a1 by a screw 6a5 fixed to the clutch rotary shaft 6a1.

For smooth engagement and disengagement between the rotary shaft 6a and the clutch sliding rotary head 6b, a shaft 6a2 is coaxially formed on an end face of the rotary shaft 6a, and the clutch sliding rotary head 6b is rotatably mounted around the shaft 6a2.

In order to position the rotary shaft 6a in the axial hole 3d, the end of the axial hole 3d is provided with a through-hole 3d1 through which the reeling drum driving shaft 6a3 extends to be connected to the curtain reeling drum 4A. The clutch rotary shaft 6a1 is located in the axial hole 3d. The side of the pull rope rotary disc 3c is provided with a positioning mandrel 3c3 pressing against an end face of the shaft 6a2. Thus, the rotary shaft 6a is positioned in the axial hole 3d without any back-and-forth movement while avoiding adverse affect to the smooth rotation of the rotary shaft 6a.

An exterior surface of the spring coil 9 abuts against an interior wall of the axial hole 3d. A longitudinally extending groove 6b2 is formed in the exterior surface of the clutch sliding rotary head 6b and receives an end 9a of the spring coil 9. The winding direction of the spring coil 9 is the same as the rotation direction in which the rotary shaft 6a is rotated by the clutch sliding rotary head 6b.

A speed reducing device 15 is connected to the reverse rotation releasing device 5. The speed reducing device 15 utilizes the technology of China Utility Model Publication No. CN2725495, the entire contents of which are incorporated herein by reference. The reverse rotation releasing device 5 utilizes the technology of China Patent Publication No. CN1693651, the entire contents of which are incorporated herein by reference.

In use of the curtain of this embodiment, the curtain cloth 7 wound around the curtain reeling drum 4A is released by operating the rotation driving device 3, and at the same time, the resilience reverse rotation mechanism 14 accumulates resiliency power for reverse rotation. When it is desired to reel the curtain cloth 7 back onto the curtain reeling drum 4A, the pull rope 3b is shortly pulled downward to initiate the reverse rotation releasing operation of the reverse rotation releasing device 5, and the curtain reeling drum 4A will be rotated reversely under the resiliency power for reverse rotation accumulated by the resilience reverse rotation mechanism 14, to rewind the curtain cloth 7 around the curtain reeling drum 4A.

Embodiment 2

Figure 12:
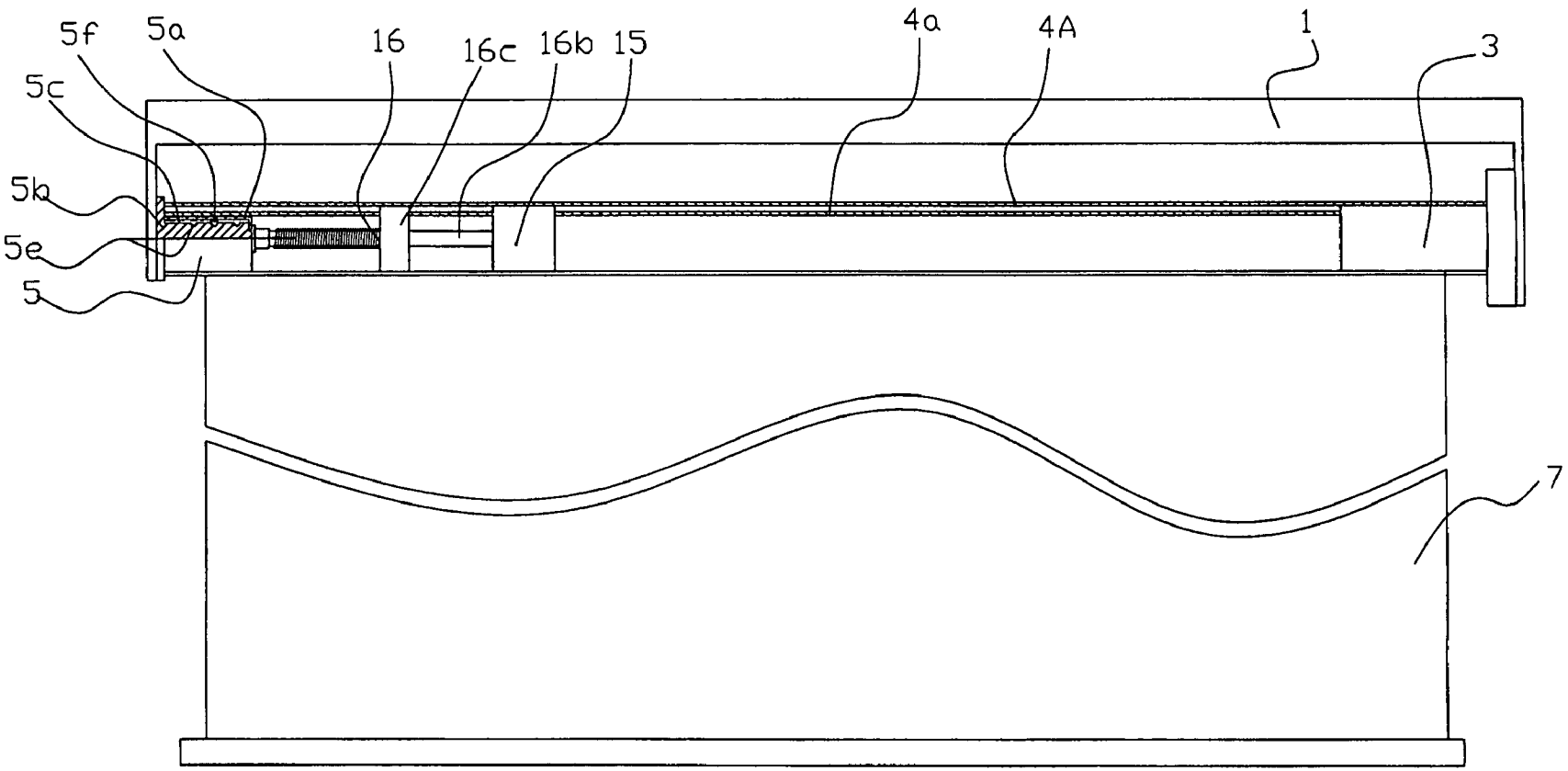
FIG. 12 is a schematic view showing structure of a second embodiment.

The present invention is comprised of a curtain bracket 1, a rotation driving device 3 mounted to an end of the curtain bracket 1, a curtain reeling drum 4A driven by the rotation driving device 3, a curtain cloth 7 driven by the curtain reeling drum 4A, and a reverse rotation releasing device 5 connected to the rotation driving device 3, as shown in FIG. 12 and FIG. 7. The rotation driving device 3 is the same as the rotation driving device 3 used in the first embodiment, as shown in FIG. 12.

Figure 8:
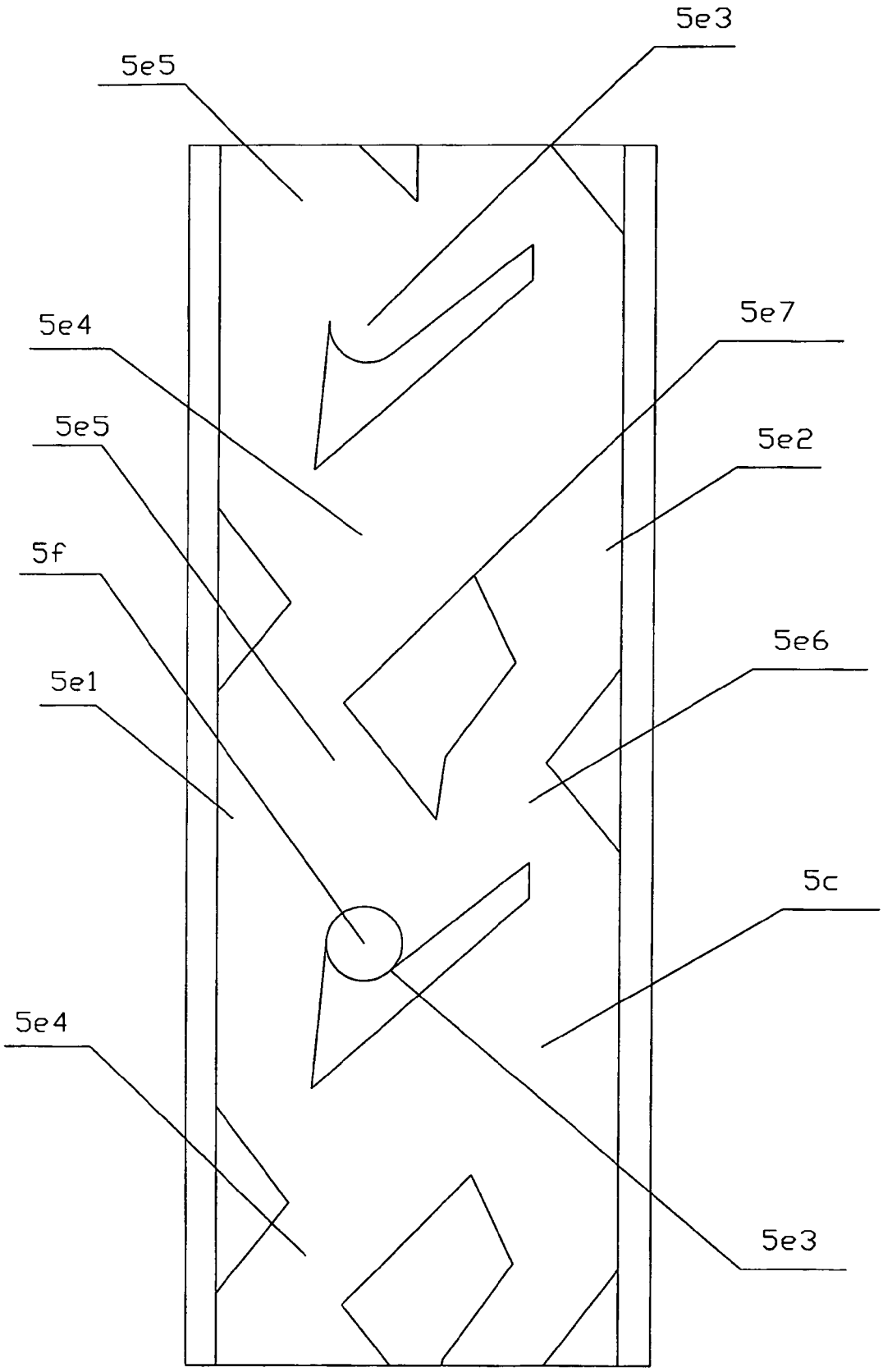
FIG. 8 is a flattened view of a surface of a sleeve of a reverse rotation releasing device.

The reverse rotation releasing device 5 is comprised of a sleeve 5a connected to the curtain reeling drum 4A, and a sleeve shaft 5b mounted in the sleeve 5a and fixed to the curtain bracket 1. As shown in FIG. 8, an interior side wall of the sleeve 5a is provided with a guide groove 5c. A continuous sliding path 5e is formed along a surface 5d of the sleeve shaft 5b. A ball 5f is mounted between the guide groove 5c and the sliding path 5e. The sliding path 5e is comprised of one or more groups of left and right sliding paths 5e1, 5e2 and an intermediate V-shaped sliding path 5e3. In a direction of the left sliding path 5e1 and the intermediate sliding path 5e3, there are guiding mouths 5e4, 5e5 for respective directions to the right sliding path 5e2 and the left sliding path 5e1. In another direction in the right sliding path 5e2, there is a guide mouth 5e6 for a direction to the intermediate V-shaped sliding path 5e3. In operation, the curtain reeling drum 4A is subjected to a reeling rotation via the rotation driving device 3, and when the sleeve 5a is driven to rotate, the ball 5f is axially moved along the guiding groove 5c and is moved along the sliding path 5e. When sleeve 5a rotates in a direction allowing the ball 5f to enter the left sliding path 5e1, if the rotation driving device 3 is stopped before the ball is moved to 5e7, under the action of the curtain cloth (or the spring force), the ball is moved in a reverse direction along the left sliding path 5e1, and the sleeve 5a is smoothly rotated relative to the sleeve shaft 5b, releasing the curtain cloth from the curtain reeling drum 4A (or reel it back to the reeling drum). Then, when the curtain reeling drum 4A is stopped from rotation via the rotation driving device 3, the sleeve 5a is rotated reversely to allow the ball 5f to enter the right sliding path 5e2 through the guiding mouth 5e4. Thereafter, if the rotation driving device 3 is stopped under the action of the gravity acting on the curtain cloth (or the spring force), the ball enters the intermediate V-shaped sliding path 5e3 via 5e6 and is trapped in the intermediate V-shaped sliding path 5e3 such that the sleeve 5a cannot be rotated. When the sleeve 5a is rotated in the direction for reeling the curtain via actuating the rotation driving device 3 again, the ball is kept moving in the right sliding path 5e2. Upon every stop, the ball will enter the V-shaped sliding path 5e3 through 5e6 to stop the curtain reeling drum 4A from rotation. When the rotation driving device 3 is actuated again, the ball passes through the guiding mouth 5e5 from the intermediate V-shaped sliding path 5e3 and is guided into the left sliding path 5e1, and the ball then enters the right sliding path 5e2 via the guiding mouth 5e4. In this way, the curtain cloth will be kept immobile when the pull rope (pull stripe) is reeled. The reverse rotation releasing device 5 allows positioning of the rotary shaft 6a when the rotary shaft 6a is in the free state. On the other hand, the reverse rotation releasing device 5 allows rotation of the rotary shaft 6a by shortly activating the pull rope 3b when the rotary shaft 6a is in the free state so that the rotary shaft 6a can be reversely rotated under a resilience force of the resilience reverse rotation mechanism 14 (wherein the curtain cloth 7 wound around the curtain reeling drum 4A is released when pulling the pull rope 3b downwardly, see FIGS. 1 and 2) or under the action of the gravity acting on the curtain cloth 7 or the shade (wherein the curtain is not provided with the resilience reverse rotation mechanism 14, and the curtain cloth 7 is wound back to the curtain reeling drum 4A when pulling the pull rope 3b downwardly, see FIG. 12).

In operation, the pull rope 3b is pulled downwardly to initiate the reverse rotation release action of the reverse rotation releasing device 5. At this time, the curtain reeling drum 4A is in a free state, and the curtain cloth 7 is, thus, released from the curtain reeling drum 4A under the action of the gravity acting on the curtain cloth 7 until the curtain cloth 7 is fully released or the operator pulls the pull rope 3b to actuate the rotation driving device 3 to thereby reversely rotate the curtain reeling drum 4A to reel the curtain cloth back to the curtain reeling drum 4A.

In order to reduce the falling speed of the curtain cloth, the reverse rotation releasing device 5 is connected to a speed reducing device 15. The speed reducing device 15 utilizes the technology of China Utility Model Publication No.

CN2725495 or China Utility Model Application Publication No. CN200991135, the entire contents of which are incorporated herein by reference.

Figure 13:
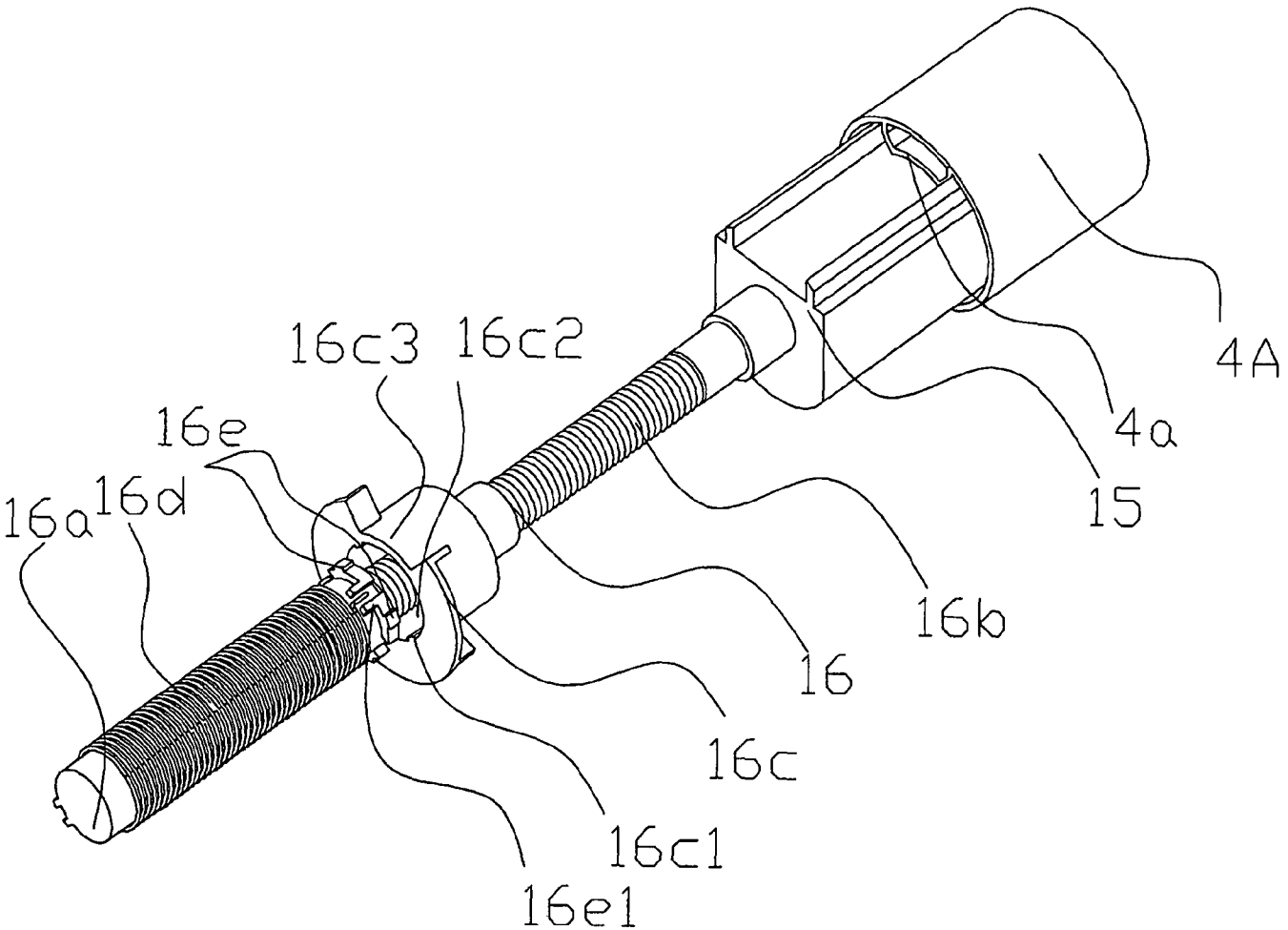
FIG. 13 is a schematic view showing structure of a curtain cloth releasing power mechanism in FIG. 12.
Figure 14:
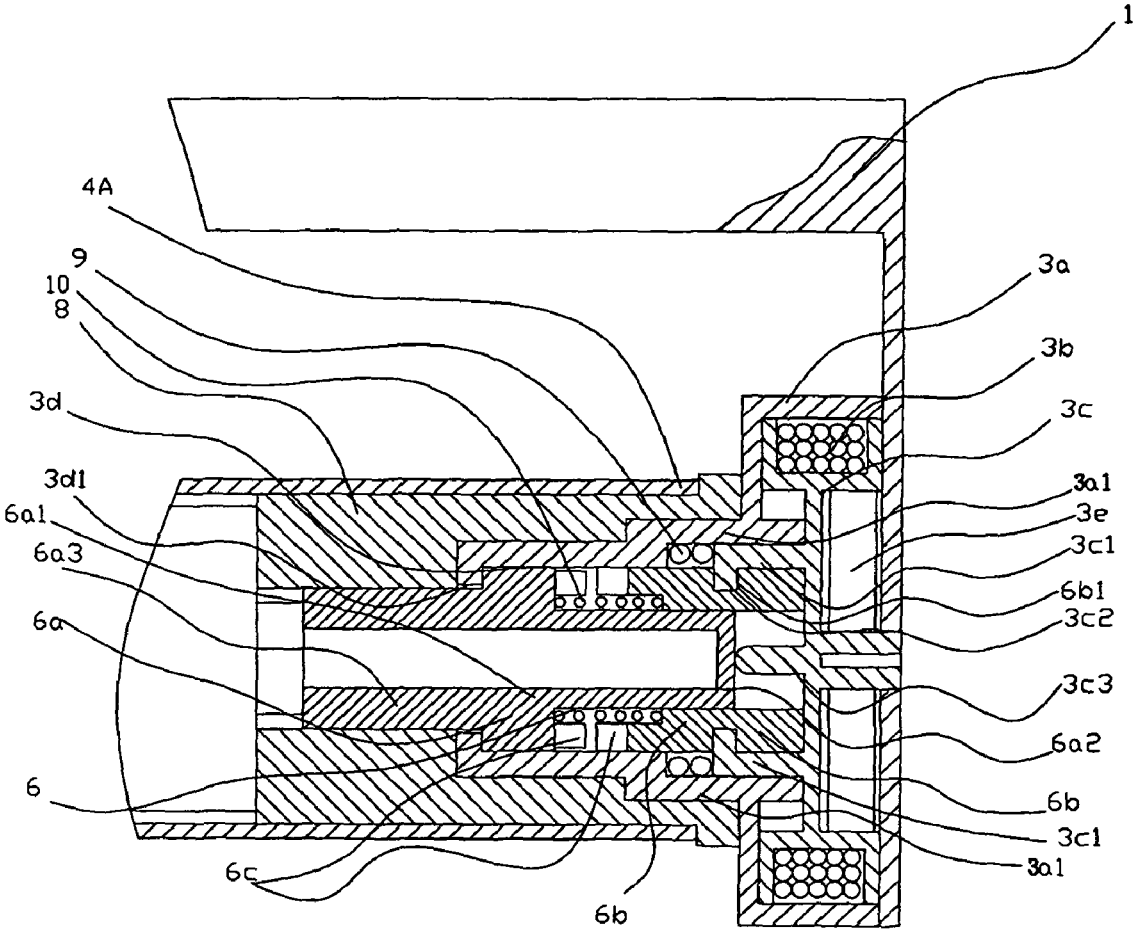
FIG. 14 is a schematic view showing structure of a rotation driving device of FIG. 12.
Figure 15:
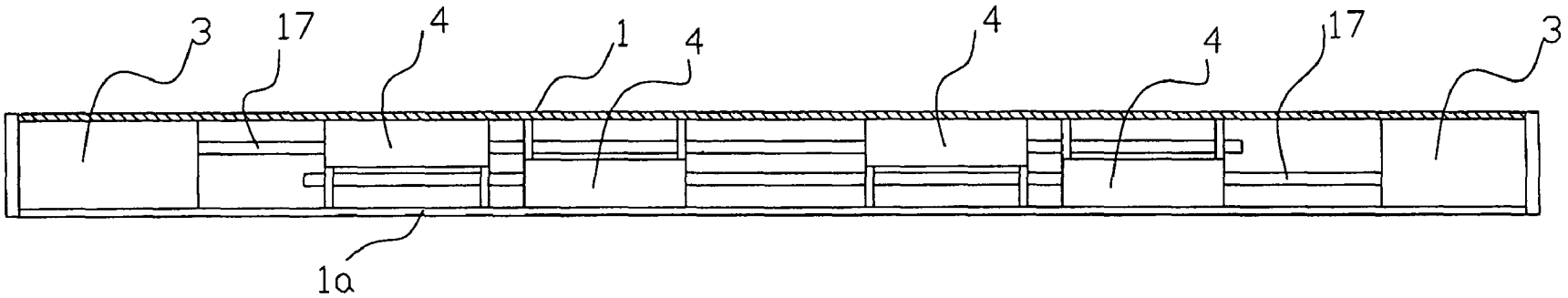
FIG. 15 is a cross sectional view according to section line A-A of FIG. 5.

In order to provide a curtain amount of release power when releasing the curtain cloth from the curtain reeling drum 4A while saving labor when reeling the curtain cloth 7, the curtain reeling drum 4A is provided with a curtain cloth releasing power mechanism 16 therein. As shown in FIG. 13, the curtain cloth releasing power mechanism 16 is comprised of a shaft 16*a* connected to the curtain bracket 1 by the sleeve shaft 5*b* of the reverse rotation releasing device 5, a screw rod 16*b* mounted to an end of the shaft, a jacket 16*c* in threading connection with the screw rod 16*b*, a spring 16*d* mounted on the shaft 16*a*, and a hook 16*e* fixed to a free end of the spring 16*d*. A fixed end of the spring 16*d* is fixed to the end of the shaft. A buckle 16*c*1 is provided on a portion of the jacket 16*c* facing the hook 16*e*. The jacket 16*c* is connected to the curtain reeling drum 4A.

The shaft 16*a* is provided with a rotary ring 16*e*1 on which the protruding hook 16*e* is formed. The end of the jacket 16*c* facing the rotary ring 16*e*1 is provided with a hole 16*c*2 matching with the rotary ring 16*e*1. The protruding buckle 16*c*1 is located in the hole 16*c*2.

The jacket 16*c* is provided with an insertion recess 16*c*3, and the curtain reeling drum 4A is provided with a longitudinal rectilinear groove 4*a* corresponding to the insertion recess 16*c*3. The jacket 16*c* is positioned on the curtain reeling drum 4A by the insertion recess 16*c*3 and the longitudinal rectilinear groove 4*a*, such that the jacket 16*c* can only move axially along the curtain reeling drum 4A. The insertion recess 16*c*3 can be formed in the curtain reeling drum 4A, and the longitudinal line groove 4*a* can be formed in the jacket 16*c*. The speed reducing device 15 is connected to the end of the screw rod 16*b*.

Embodiment 3

Figure 3:
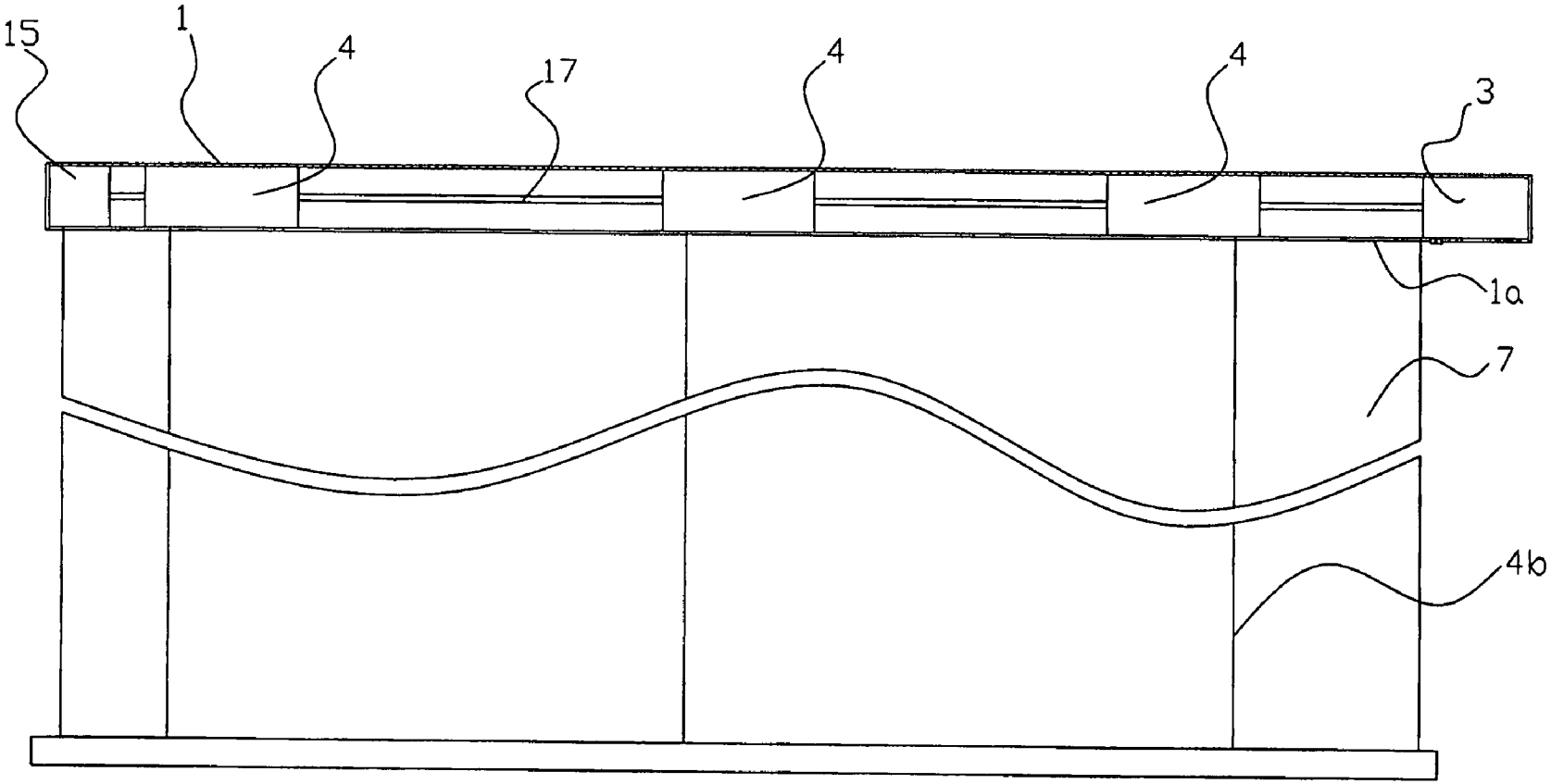
FIG. 3 is a schematic view showing structure of a third embodiment of the present invention.
Figure 4:
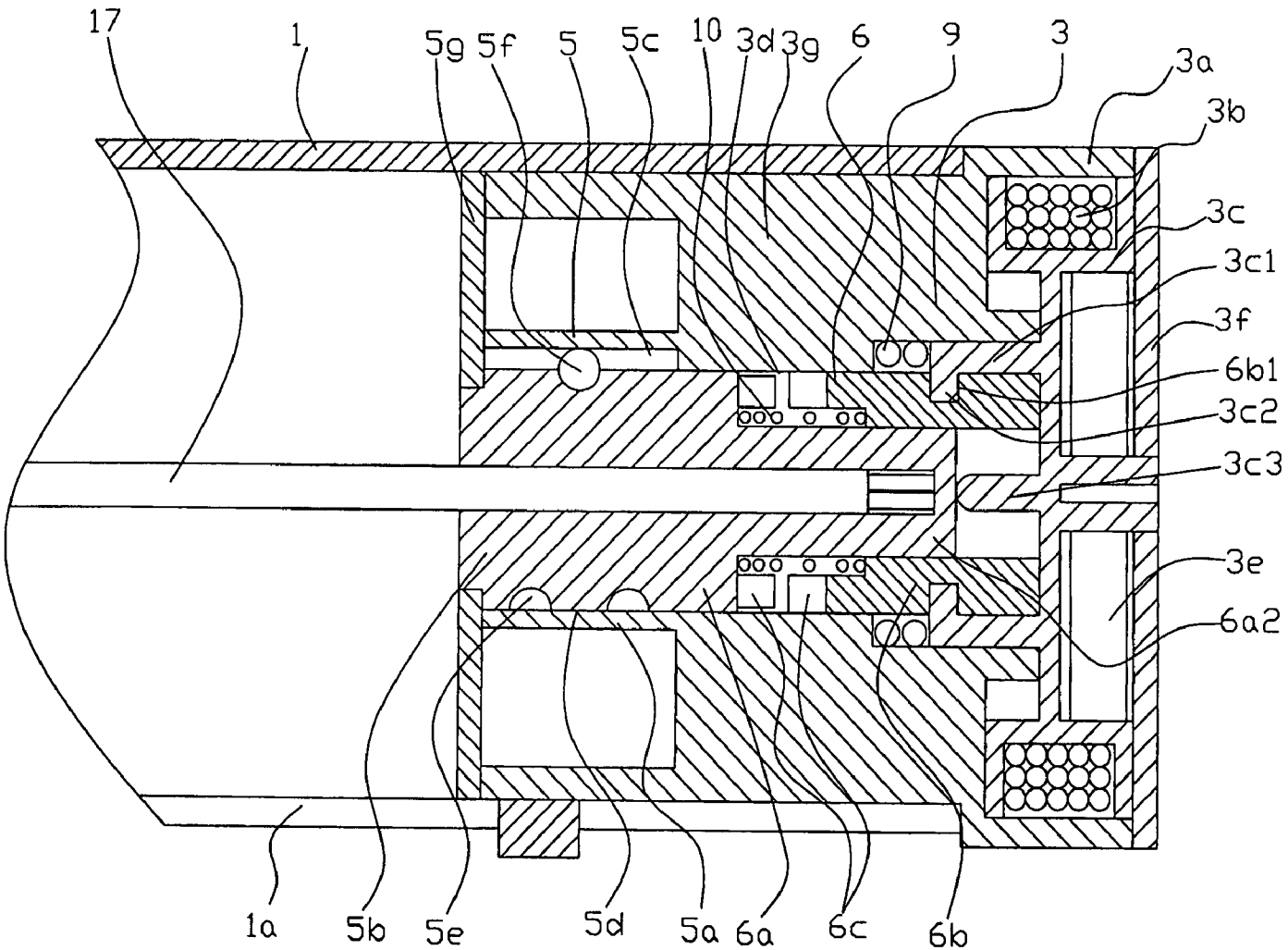
FIG. 4 is a schematic view showing structure of a rotation drive device of FIG. 3.

The present invention is comprised of a curtain bracket 1 with a rope reeling guide groove 1*a*, a rotation driving device 3 mounted on the curtain bracket 1, a plurality of reeling rope devices 4 mounted on the curtain bracket 1 and driven by the rotation driving device 3, a curtain cloth or shade 7 driven by the reeling rope devices 4, and a reverse rotation releasing device 5 connected to the rotation driving device 3, as shown in FIGS. 3, 4, and 7. The rotation driving device 3 is comprised of a pull rope (pull tape) rotary disc box 3*a* secured to the curtain bracket 1, a pull rope rotary disc 3*c* rotatably mounted in the pull rope (pull tape) rotary box 3*a* and wound with a pull rope (pull stripe) 3*b*, and a unidirectional clutch device 6 connected to the pull rope rotary disc 3*c*. A rewinding spring 3*e* is mounted between the pull rope rotary disc 3*c* and the pull rope rotary disc box 3*a*. A cover 3*f* is fixed by a screw to an opening of the pull rope rotary disc box 3*a* to position the pull rope rotary disc 3*c* on the pull rope rotary disc box 3*a*. The reeling rope devices 4 utilize the technology of China Patent Publication No. CN201106396, the entire contents of which are incorporated herein by reference. The unidirectional clutch device 6 is comprised of a clutch body 3*g* connected to the pull rope rotary disc box 3*a* and having an axial hole 3*d*, a rotary shaft 6*a* mounted in the axial hole 3*d* of the clutch body 3*g* for actuating the reeling rope devices 4 via a transmission shaft 17, and a clutch sliding rotary head 6*b* positioned at one of the ends of the rotary shaft 6*a*. Teeth 6*c* for unidirectional engagement are provided on end faces where the rotary shaft 6*a* is connected to the clutch sliding rotary head 6*b*. A jacket 3*e*1 is provided on the side of the pull rope rotary disc 3*c*. The other end of the clutch sliding rotary head 6*b* is located inside of the jacket 3*c*1 at the side of the pull rope rotary disc 3*c*. The other end of the clutch sliding rotary head 6*b* includes an exterior surface with an inclined slot 6*b*1. A slider 3*c*2 is mounted in the jacket 3*c*1 at the side of the pull rope rotary disc 3*c* and corresponding to the inclined slot 6*b*1. A spring coil 9 is connected between the exterior surface of the clutch sliding rotary head 6*b* and the axial hole 3*d* of the clutch body 3*g*. An exterior surface of the spring coil 9 abuts against the interior wall of the axial hole 3*d*. A longitudinally extending groove 6*b*2 is formed in an exterior wall of the clutch sliding rotary head 6*b* and receives an end 9*a* of the spring coil 9. The winding direction of the spring coil 9 is the same as the rotation direction in which the rotary shaft 6*a* is rotated by the clutch sliding rotary head 6*b*. A press spring 10 is provided between the rotary shaft 6*a* and the clutch sliding rotary head 6*b*.

In order to allow the rotary shaft 6*a* to be smoothly engaged with the clutch sliding rotary head 6*b*, a shaft 6*a*2 is coaxially formed on an end face of the rotary shaft 6*a*, and the clutch sliding rotary head 6*b* is rotatably mounted around the shaft 6*a*2. A positioning mandrel 3*c*3 pressing against the end surface of the shaft 6*a*2 is provided on the side of the pull rope rotary disc 3*c*.

The reverse rotation releasing device 5 is comprised of a sleeve 5*a* which is in communication with the axial hole 3*d* of the clutch body 3*g* and a sleeve shaft 5*b* which is mounted in the sleeve 5*a* and which is connected to the rotary shaft 6*a*. The transmission shaft 17 is extended through the sleeve shaft 5*b*. An interior side wall of the sleeve 5*a* is provided with a guide groove 5*c*. As can be seen from FIG. 8, a continuous sliding path 53 is formed along a surface 5*d* of the sleeve shaft 5*b*. A ball 5*f* is mounted between the guide groove 5*c* and the sliding path 5*e*. The sliding path 5*e* is comprised of one or more groups of left and right sliding paths 5*e*1, 5*e*2 and an intermediate V-shaped sliding path 5*e*3. In a direction of the left sliding path 5*e*1 and the intermediate sliding path 5*e*3, there are guiding mouths 5*e*4, 5*e*5 for respective directions to the right sliding path 5*e*2 and the left sliding path 5*e*1. In another direction of the right sliding path 5*e*2, there is a guide mouth 5*e*6 for a direction to the intermediate V-shaped sliding path 5*e*3. A cover 5*g* is fixed to an exterior opening of the sleeve 5*a* by a screw. In operation, the sleeve shaft 5*b* is rotated together with the rotary shaft 17 such that the ball 5*f* is axially displaced along the guide groove 5*c* and is moved along the sliding path 5*e*. When the sleeve shaft 5*b* is rotated in a direction allowing the ball 5*f* to enter the right sliding path 5*e*2, the sleeve shaft 5*b* is smoothly rotated to actuate the transmission shaft 17 to rotate to close the curtain. When the sleeve shaft 5*b* stops rotating, the transmission shaft 17 is driven to move as a result of the gravity acting on the curtain cloth or the shade 7. Accordingly, the sleeve shaft 5*b* is reversely rotated slightly to thereby allow the ball 5*f* to pass through the guide mouth 5*e*6 to enter the intermediate V-shaped sliding path 5*e*3 and to be trapped therein. Thus, the sleeve shaft 5*b* is unable to be rotated reversely, until the sleeve shaft 5*b* is rotated through a small angle by the rotation driving device 3 in the direction of retracting the curtain cloth, such that the ball 5*f* is allowed to pass through the guiding mouth 5*e*5 from the intermediate V-shaped sliding path 5*e*3 and into the left sliding path 5*e*1 and is, thus, no longer trapped in the intermediate V-shaped sliding path 5*e*3. Accordingly, the sleeve shaft 5*b* is rotated reversely by the transmission shaft 17 which is driven by the gravity acting on the curtain cloth or the shade 7, thereby opening the curtain.

A speed reducing device 15 is mounted to the other end of the curtain bracket 1 and is connected to the transmission shaft 17.

Figure 9:
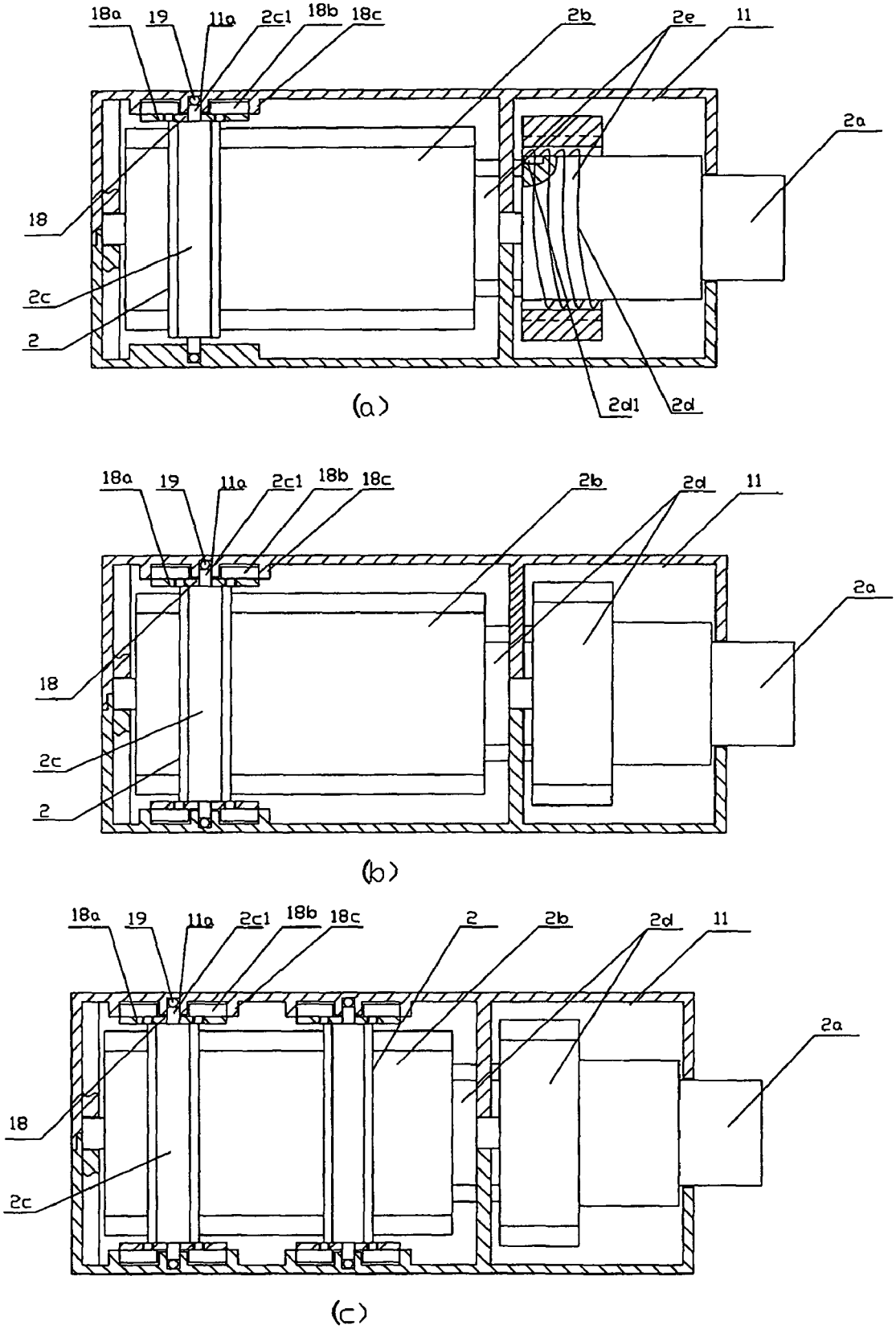
FIG. 9 is a schematic view showing structure of a speed reducing device of FIG. 3.

As shown in FIG. 9(*a*), the speed reducing device 15 of the first embodiment is comprised of a box body 11, a speed shifting mechanism 2 mounted in the box body 11 and connected to the curtain transmission shaft, and a frictional speed reducing mechanism 18 driven by the speed shifting mechanism 2. The speed shifting mechanism 2 is comprised of a rotary shaft 2*a*, a gear 2*b* coupled to the rotary shaft 2*a*, and a worm 2*c* engaged with the gear 2*b*. Output shafts 2*c*1 of the worm 2*c* are mounted in the box body 11 via bearings 19. One of the output shafts 2*c*1 of the worm 2*c* is connected to the frictional speed reducing mechanism 18. The frictional speed reducing mechanism 18 is comprised of a rotary base 18*a*, a friction block 18*b* swingingly connected to the rotary base 18*a*, and a circular chamber 18*c* formed in the box body 11. The friction block 18*b* is positioned in the circular chamber 18*c*. In order to increase the speed change ratio, a gear transmission device 2*e* is connected between the gear 2*b* and the rotary shaft 2*a*. In order to enhance the frictional speed reducing effect, the output shafts at both ends of the worm 2*c* are connected to the frictional speed reducing mechanism 18. The bearing 19 is a steel ball mounted between an axial hole 11*a* and the output shaft 2*c*1 on the worm 2*c*.

When a user operates the rotation driving device 3 to retract the curtain and to prevent the force applied by the user to the rotation driving device 3 from being increased by the speed reducing resistance of the speed reducing device 15, a spring coil 2*d* is mounted between the rotary shaft 2*a* and the gear 2*b* with an end 2*d*1 of the spring coil 2*d* connected to the rotary shaft 2*a* or the gear 2*b*. In a case with the end of the spring coil 2*d* connected to the rotary shaft 2*a*, the winding direction of the spring coil 2*d* along the connection point end 2*d*1 is opposite to a driving rotation direction of the rotation driving device 3. In another case with the one end 2*d*1 of the spring coil 2*d* connected to the gear 2*b*, the winding direction of the spring coil 2*d* along the connection point end 2*d*1 is the same as the driving rotation direction of the rotation driving device 3. In operation, when the user operates to retract the curtain by the rotation driving device 3, the rotation direction of the rotary shaft 2*a* makes the rotary shaft 2*a* unable to actuate the gear 2*b* by the spring coil 2*d* such that the frictional speed reducing mechanism 18 does not act, to prevent the force applied by the user to the rotation driving device 3 for retracting the curtain from being increased by the speed reducing resistance of the speed reducing device 15.

The speed reducing device 15 of embodiment 2 is shown in FIG. 9(*b*), in which the output shafts at both ends of the worm 2*c* are connected to the friction speed reducing mechanism 18 on the basis of the speed reducing device 15 of embodiment 1.

The speed reducing device 15 of embodiment 3 is shown in FIG. 9(*c*), which involves two or more sets of speed shifting mechanisms 2 and frictional speed reducing mechanisms 18 on the basis of the aforementioned embodiment.

Embodiment 4

Figure 5:
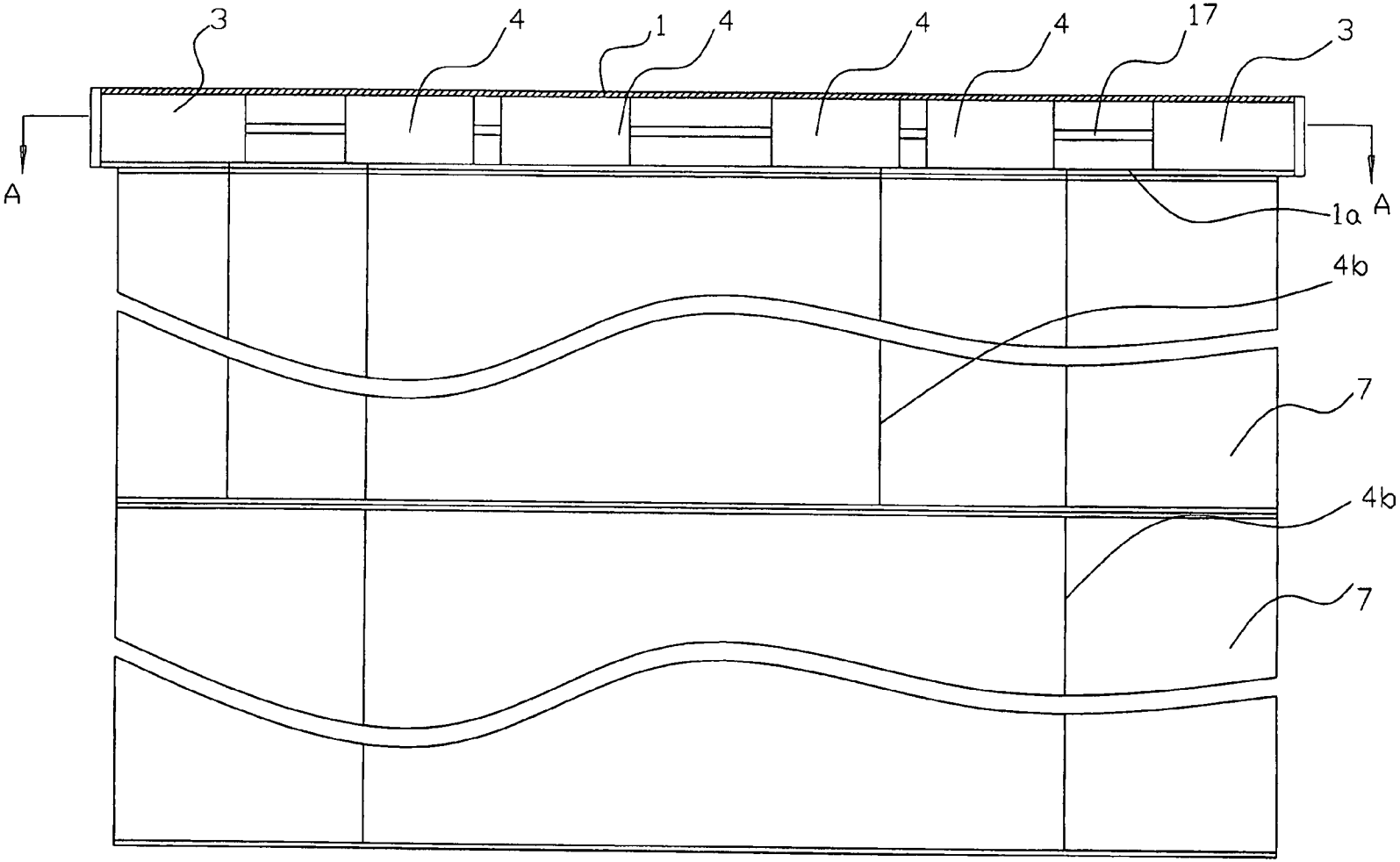
FIG. 5 is a schematic view showing structure of a fourth embodiment of the present invention.
Figure 6:
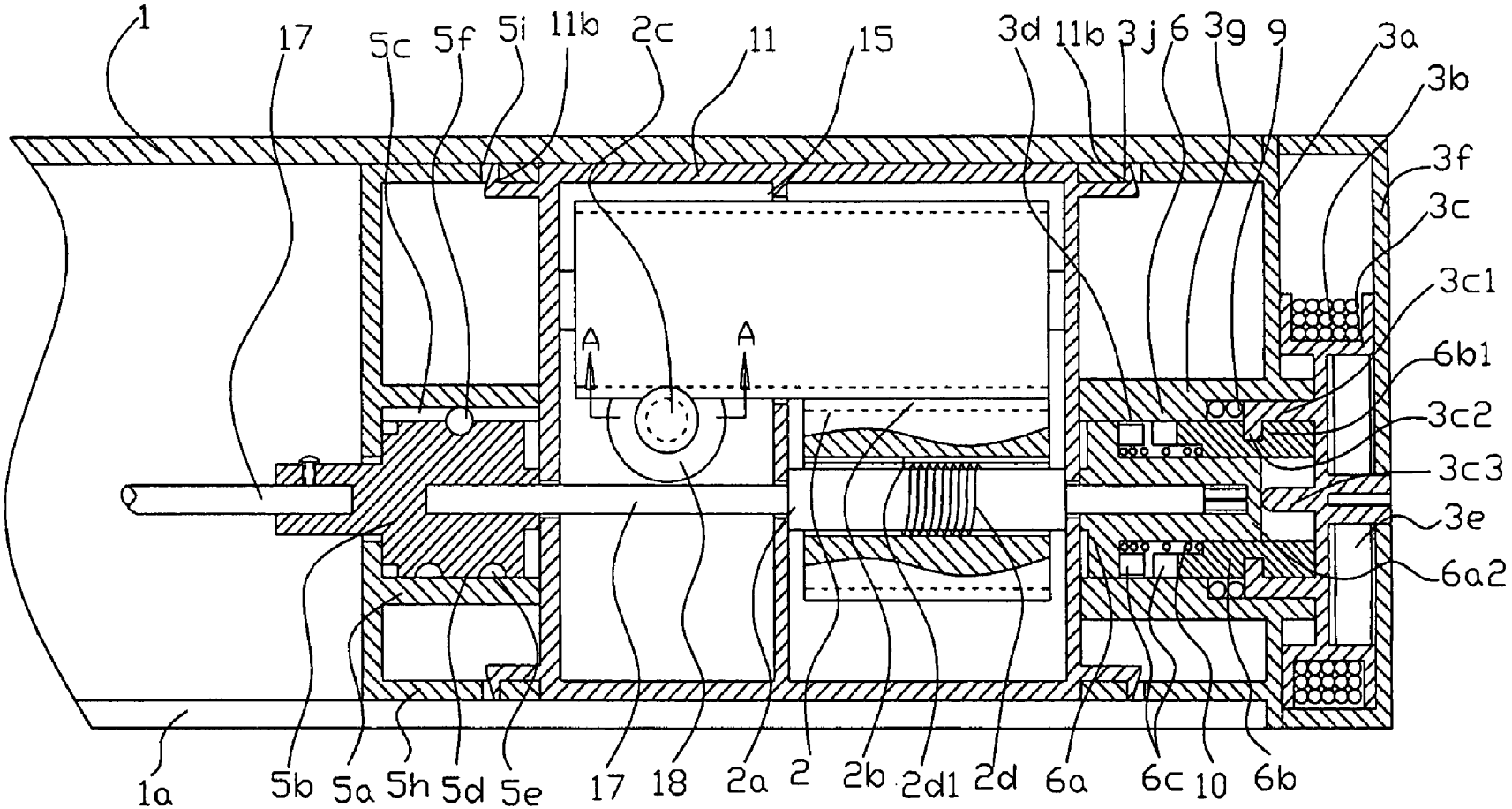
FIG. 6 is a schematic view showing structure of a rotation drive device of FIG. 5.

The present invention is comprised of a curtain bracket 1 with a rope reeling guide groove 1*a*, rotation driving devices 3 mounted on two ends of the curtain bracket 1, two reeling rope devices 4 mounted on the curtain bracket 1 and driven by two sets of rotation driving devices 3, two sets of curtain cloths or shades 7 driven by the reeling rope devices 4, and reverse rotation releasing devices 5 connected to the rotation driving devices 3, as shown in FIGS. 5, 6, and 7. The two sets of curtain cloths or shade 7 are connected end to end. Each rotation driving device 3 is comprised of a pull rope rotary disc box 3*a* secured to the curtain bracket 1, a pull rope rotary disc 3*c* rotatably mounted in the pull rope (pull tape) rotary box 3*a* and wound with a pull rope (pull tape) 3*b*, and a unidirectional clutch device 6 connected to the pull rope rotary disc 3*c*. A rewinding spring 3*e* is mounted between the pull rope rotary disc 3*c* and the pull rope rotary disc box 3*a*. A cover 3*f* is fixed by a screw to an opening of the pull rope rotary disc box 3*a* to position the pull rope rotary disc 3*c* on the pull rope rotary disc box 3*a*. The reeling rope device 4 utilizes the technology of China Patent Publication No. CN201106396. The unidirectional clutch device 6 is comprised of a clutch body 3*g* connected to the pull rope rotary disc box 3*a* and having an axial hole 3*d*, a rotary shaft 6*a* mounted in the axial hole 3*d* of the clutch body 3*g* for actuating the reeling rope device 4 via a transmission shaft 17, and a clutch sliding rotary head 6*b* positioned on one of two ends of the rotary shaft 6*a*. Teeth 6*c* for unidirectional engagement are provided on end faces where the rotary shaft 6*a* is connected to the clutch sliding rotary head 6*b*. A jacket 3*c*1 is provided on a side of the pull rope rotary disc 3*c*. The other end of the clutch sliding rotary head 6*b* is located in the jacket 3*e*1 at the side of the pull rope rotary disc 3*c*. The other end of the clutch sliding rotary head 6*b* includes an exterior surface with an inclined slot 6*b*1. A slider 3*c*2 is mounted in the jacket 3*c*1 at the side of the pull rope rotary disc 3*c* and corresponding to the inclined slot 6*b*1. A spring coil 9 is connected between the exterior surface of the clutch sliding rotary head 6*b* and the axial hole 3*d* of the clutch body 3*g*. An exterior surface of the spring coil 9 abuts against an interior wall of the axial hole 3*d*. A longitudinally extending groove 6*b*2 is formed in an exterior wall of the clutch sliding rotary head 6*b* and receives an end 9*a* of the spring coil 9. The winding direction of the spring coil 9 is the same as the rotation direction in which the rotary shaft 6*a* is rotated by the clutch sliding rotary head 6*b*. A press spring 10 is provided between the rotary shaft 6*a* and the clutch sliding rotary head 6*b*.

In order to allow the rotary shaft 6*a* to be smoothly engaged with the clutch sliding rotary head 6*b*, a shaft 6*a*2 is coaxially formed on the end face of the rotary shaft 6*a*, and the clutch sliding rotary head 6*b* is rotatably mounted around the shaft 6*a*2. A positioning mandrel 3*c*3 pressing against the end surface of the shaft 6*a*2 is formed on the side of the pull rope rotary disc 3*c*.

Each reverse rotation releasing device 5 is comprised of a sleeve 5*a* connected to the curtain bracket 1 and a sleeve shaft 5*b* which is mounted in the sleeve 5*a* and connected to the rotary shaft 6*a* by the transmission shaft 17. The transmission shaft 17 connected to the reeling rope devices 4 is extended through the sleeve shaft 5*b*. A guide groove 5*c* is formed in an interior side wall of the sleeve 5*a*. A continuous sliding path 5*e* is provided along a surface 5*d* of the sleeve shaft 5*b*. A ball 5*f* is mounted between the guide groove 5*c* and the sliding path 5*e*. As shown in FIG. 8, the sliding path 5*e* is comprised of one or more groups of left and right sliding paths 5*e*1, 5*e*2 and an intermediate V-shaped sliding path 5*e*3. In a direction of the left sliding path 5*e*1 and the intermediate sliding path 5*e*3, there are guiding mouths 5*e*4, 5*e*5 for respective directions to the right sliding path 5*e*2 and the left sliding path 5*e*1. In another direction of the right sliding path 5*e*2, there is a guide mouth 5*e*6 for a direction to the intermediate V-shaped sliding path 5*e*3. In operation, the sleeve shaft 5*b* is rotated together with the rotary shaft 6*a* such that the ball 5*f* is axially displaced along the guide groove 5*c* and is moved along the sliding path 5*e*. When the sleeve shaft 5*b* is rotated in the direction allowing the ball 5*f* to enter the right sliding path 5*e*2, the sleeve shaft 5*b* is smoothly rotated to actuate the transmission shaft 17 to rotate to close the curtain. When the sleeve shaft 5*b* stops rotating, the transmission shaft 17 is driven to move as a result of the gravity acting on the curtain cloths or the shades 7. Accordingly, the sleeve shaft 5*b* is reversely rotated slightly to thereby allow the ball 5*f* to pass through the guide mouth 5*e*6 to enter the intermediate V-shaped sliding path 5*e*3 and be trapped therein. Thus, the sleeve shaft 5*b* is unable to be rotated reversely, until the sleeve shaft 5*b* is rotated through a small angle by the rotation driving device 3 in the direction retracting the curtain cloth, such that the ball 5*f* is allowed to pass through the guiding mouth 5*e*5 from the intermediate V-shaped sliding path 5*e*3 and into the left sliding path 5*e*1 and is, thus, no longer trapped in the intermediate V-shaped sliding path 5*e*3. Accordingly, the sleeve shaft 5*b* is rotated reversely by the transmission shaft 17 which is driven by the gravity acting on the curtain cloths or the shades 7, thereby opening the curtain.

Figure 10:
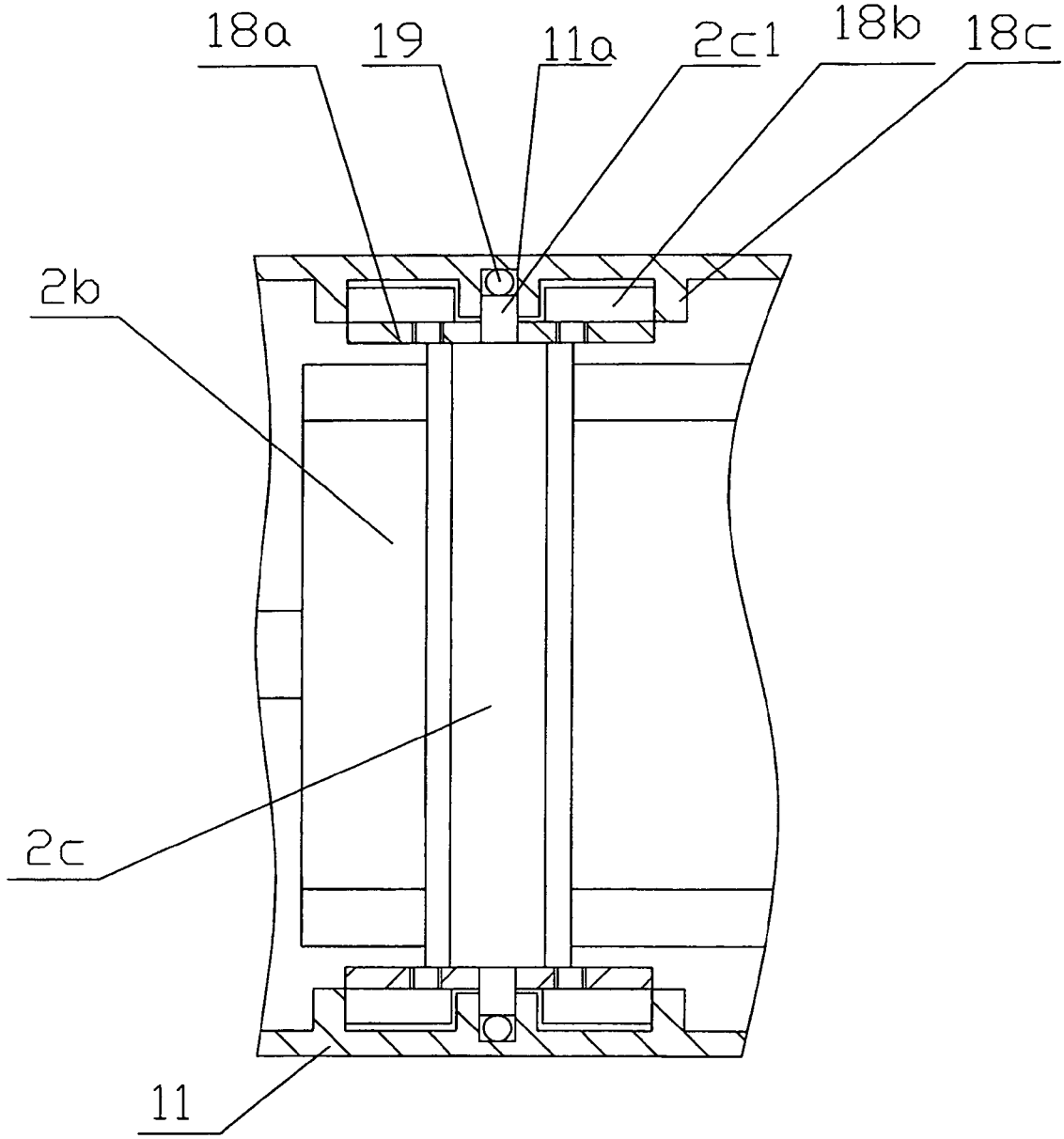
FIG. 10 is a cross sectional view according to section line A-A of FIG. 6.

A speed reducing device 15 is mounted on the curtain bracket 1 and connected to the transmission shaft 17. The speed reducing device 15 is comprised of a box body 11, a speed shifting mechanism 2 mounted in the box body 11 and connected to the curtain transmission shaft 17, and a frictional speed reducing mechanism 18 driven by the speed shifting mechanism 2. The speed shifting mechanism 2 is comprised of a rotary shaft 2*a*, a gear or a gear train 2*b* coupled to the rotary shaft 2*a*, and a worm 2*c* engaged with the gear or an output gear of the gear train 2*b*. The output shafts of the worm 2*c* are mounted in the box body 11 via bearings 19. One of the output shafts of the worm 2*c* is connected to the frictional speed reducing mechanism 18. As shown in FIG. 10, the frictional speed reducing mechanism 18 is comprised of a rotary base 18*a*, a friction block 18*b* swingingly connected to the rotary base 18*a*, and a circular chamber 18*c* formed in the box body 11. The friction block 18*b* is positioned in the circular chamber 18*c*. In order to enhance the frictional speed reducing effect, the output shafts of both ends of the worm 2*c* are connected to the frictional speed reducing mechanism 18. The bearing 19 is a steel ball mounted between an axial hole 11*a* and the output shaft 2*c*1 on the worm 2*c*.

The sleeve 5*a* of the reverse rotation releasing device 5 is connected to the curtain bracket 1 by a sleeve box 5*h*. Both ends of the box body 11 of the speed reducing device are provided with fixing hooks 11*b*. The sleeve box 5*h* and the pull rope rotary disc box 3*a* of the rotation driving device 3 corresponding to the fixing hooks 11*b* are respectively provided with buckles 5*i*, 3*j*. The reverse rotation releasing device 5 and the rotation driving device 3 are respectively connected to both ends of the speed reducing device 15 by the fixing hooks 11*b* and the buckles 5*i*, 3*j*. The combination of the rotation driving device 3, the speed reducing device 15, and the reverse rotation releasing device 5 together allow reasonable arrangements of the mechanisms on the curtain bracket 1 to assure successful use of various kinds of curtain cloths or shades.

Figure 11:
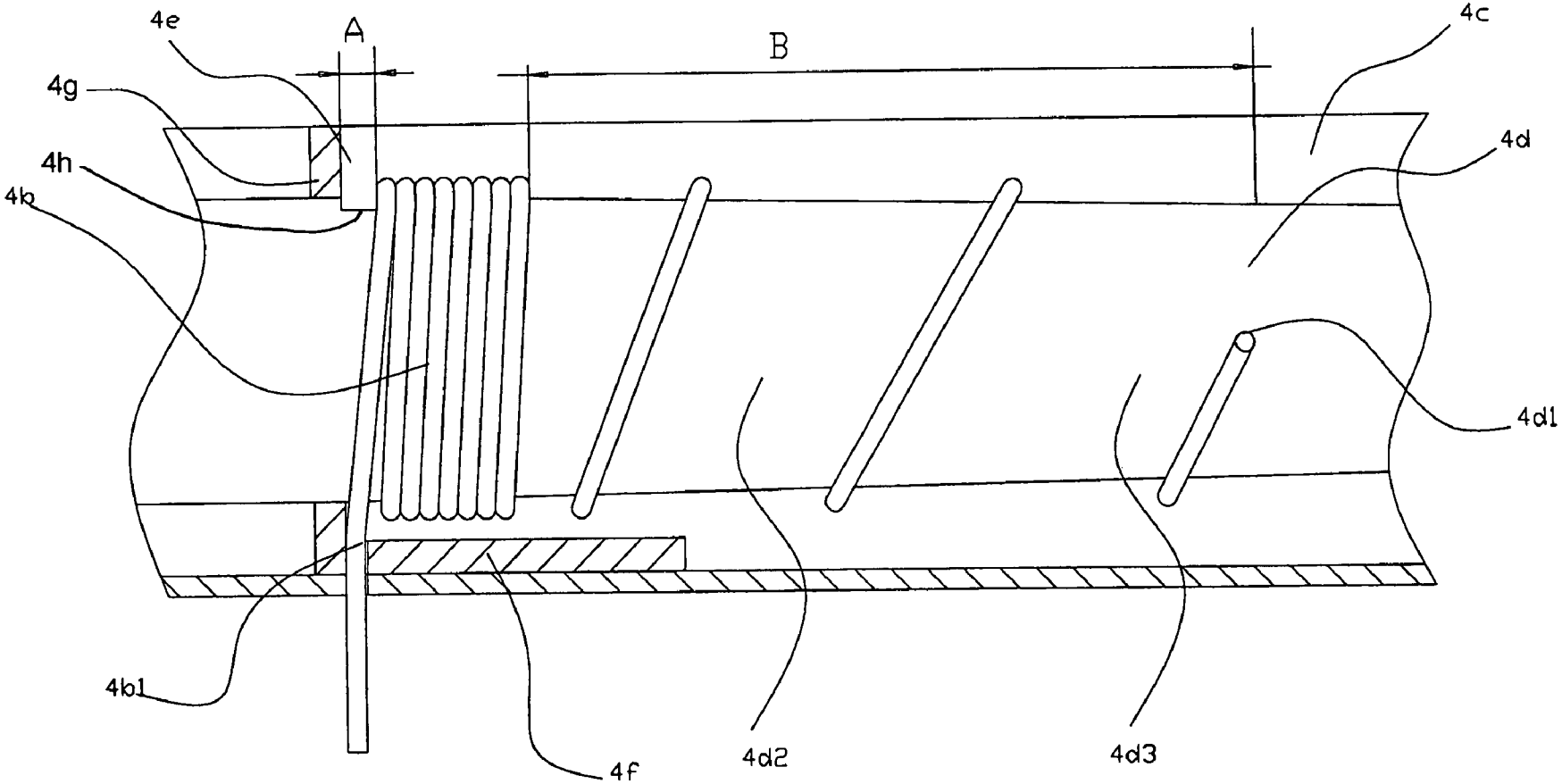
FIG. 11 is a schematic view showing structure of a reeling rope device in FIG. 3 and FIG. 5.

As shown in FIG. 11, the reeling rope device 4 in the embodiments 3 and 4 is comprised of a support 4*c*, a reeling shaft 4*d* mounted in the support 4*c* and driven by the rotation driving device 3, a stopper 4*e* mounted on the reeling shaft 4*d* and having an interior surface 4*h* tightly pressing against the reeling shaft 4*d*, a reeling rope guiding device 4*f* mounted beneath the reeling shaft 4*d* and corresponding to the stopper 4*e*, and a reeling rope 4*b* which has one end fixed to the reeling shaft 4*d* away from the stopper 4*e* and which has the other end extending through the reeling rope guiding device 4*f* and connected to the curtain cloth 7. The stopper 4*e* is connected to a bearing 4*g* on the support 4*c* on the reeling shaft 4*d*. The stopper 4*e* is located in a position in front of a position 4*b*1 from which the reeling rope 4*b* of the reeling rope guiding device 4*f* comes out. Furthermore, the distance A between the position of the stopper 4*e* and the position 4*b*1 from which the reeling rope 4*b* of the reeling rope guiding device 4*f* comes out is not smaller than the diameter of the reeling rope 4*b*. At least one section B on the reeling shaft 4*d* around which the reeling rope 4*b* is wound has decreasing diameters towards a fixed point 4*d*1 of the reeling rope 4*b* on the reeling shaft 4*d* (including a specific example in which the reeling shaft 4*d* is a tapered shaft). The diameter of a front reeling shaft 4*d*2 of the reeling shaft 4*d* wound with the reeling rope 4*b* in the direction of the reeling rope 4*b* at the fixed point 4*d*1 on the reeling shaft 4*d* is not smaller than that of a rear reeling shaft 4*d*3 of the reeling shaft 4*d*.

What is claimed is:

1. A curtain comprising a curtain bracket, a rotation driving device mounted on an end of the curtain bracket, a curtain reeling drum or a reeling rope device driven by the rotation driving device, a curtain cloth driven by the curtain reeling drum or a curtain cloth or shade driven by a reeling rope of the reeling rope device, and a reverse rotation releasing device connected to the rotation driving device, wherein the rotation driving device comprises a pull rope rotary disc box fixed to the curtain bracket, a pull rope rotary disc rotatably mounted in the pull rope rotary disc box and wound with a pull rope for drawing downwardly to drive the pull rope rotary disc to rotate, and a unidirectional clutch device connected to the pull rope rotary disc, wherein a rewinding spring is provided between the pull rope rotary disc and the pull rope rotary disc box or the curtain bracket for reversely rotating the pull rope rotary disc to reel the pull rope back to the pull rope rotary disc when releasing the pull rope, wherein the unidirectional clutch device comprises an axial hole connected to the pull rope rotary disc box, a rotary shaft mounted in the axial hole for driving the curtain reeling drum or the reeling rope device, and a clutch sliding rotary head located on one end of the rotary shaft, wherein teeth for unidirectional engagement are formed on end surfaces where the rotary shaft and the clutch sliding rotary head are connected, wherein a jacket is mounted on a side of the pull rope rotary disc, wherein another end of the clutch sliding rotary head is located in the jacket at the side of the pull rope rotary disc, wherein an inclined slot is formed in an exterior surface of the other end of the clutch sliding rotary head, wherein a slider is mounted in the jacket at the side of the pull rope rotary disc and corresponding to the inclined slot, wherein a spring coil is connected between the exterior surface of the clutch sliding rotary head and the axial hole, and wherein the jacket and the slider are rotated together with the pull rope rotary disc when the pull rope rotary disc is rotated.

2. The curtain according to claim 1, wherein the coil has an exterior surface abutting against an interior wall of the axial hole, and wherein a longitudinally extending groove is formed in the exterior surface of the clutch sliding rotary head and receives an end of the spring coil.

3. The curtain according to claim 2, wherein the spring coil is wound in a direction identical to a rotating direction of the rotary shaft driven by the clutch sliding rotary head.

4. The curtain according to claim 3, wherein a shaft is coaxially formed on an end face of the rotary shaft, and wherein the clutch sliding rotary head is rotatably mounted around the shaft.

5. The curtain according to claim 4, wherein a positioning mandrel is provided on the side of the pull rope rotary disc and presses against the end surface of the shaft.

6. The curtain according to claim 5, wherein a pressure spring is provided between the rotary shaft and the clutch sliding rotary head for biasing the clutch sliding rotary head away from the rotary shaft.

7. The curtain according to claim 1, wherein the pull rope rotary disc box is provided with a reeling drum shaft having the axial hole, and wherein the curtain reeling drum is rotatably mounted to the reeling drum shaft of the pull rope rotary disc box by a reeling jacket tube.

8. The curtain according to claim 7, wherein a sleeve with external threading is mounted in the curtain reeling drum and connected to the pull rope rotary disc box, wherein the sleeve is threadedly engaged with a positioning stopper having a notch to be engaged with a longitudinal rectilinear groove of an interior wall of the curtain reeling drum, and wherein the positioning stopper is transversely and slideably connected in the curtain reeling drum in which a resilience reverse rotation mechanism is disposed.

9. The curtain according to claim 8, wherein a projecting stopper is provided on a side of the positioning stopper, and wherein a baffler corresponding to the projecting stopper is provided on the pull rope rotary disc box or the jacket sleeve.

10. The curtain according to claim 9, wherein an outer diameter of the end of the sleeve is larger than that of the reeling drum shaft.

11. The curtain according to claim 8, wherein the rotary shaft comprises a clutch rotary shaft and a reeling drum driving shaft, wherein a driving wheel is provided on an end portion of the reeling drum driving shaft, wherein the driving wheel connected to the curtain reeling drum includes a notch to be engaged with the longitudinal rectilinear groove in the interior wall of the curtain reeling drum, wherein the sleeve is mounted around the reeling drum driving shaft between the driving wheel and the reeling drum shaft of the pull rope rotary disc box, and wherein the reeling drum shaft is connected to the sleeve by a connecting member.

12. The curtain according to claim 11, wherein the reeling drum driving shaft mounted around to the clutch rotary shaft has a non-circular interior hole, wherein the clutch rotary shaft has a non-circular outline corresponding to the interior hole, and wherein the reeling drum driving shaft mounted around the clutch rotary shaft is connected to the clutch rotary shaft by a screw fixed to the clutch rotary shaft.

13. The curtain according to claim 12, wherein the reverse rotation releasing device of the curtain reeling drum is connected to a speed reducing device.

14. The curtain according to claim 7, wherein the reverse rotation releasing device is connected to a speed reducing device.

15. The curtain according to claim 14, that wherein a curtain cloth releasing power mechanism is mounted in the curtain reeling drum, wherein the curtain cloth releasing power mechanism comprises a shaft connected to the curtain bracket by the reeling drum shaft of the reverse rotation releasing device, a screw rod mounted to an end of the shaft, a jacket threadedly engaged with the screw rod, a shaft spring mounted on the shaft, and a protruding hook fixed to a free end of the shaft spring, wherein a fixed end of the shaft spring is secured to the end of the shaft, wherein the jacket includes a protruding buckle in a position opposite to the hook, and wherein the jacket is connected to the curtain cloth reeling drum.

16. The curtain according to claim 15, wherein a rotary ring is provided on the shaft, wherein the protruding hook is provided on the rotary ring, wherein a hole to be engaged with the rotary ring is formed in an end of the jacket which includes the rotary ring, and wherein the protruding buckle is mounted in the hole.

17. The curtain according to claim 16, wherein an insertion recess is formed in the jacket, wherein a longitudinal rectilinear groove corresponding to the insertion recess is formed in the curtain cloth reeling drum, wherein the jacket is mounted on the curtain cloth reeling drum by the insertion recess and the longitudinal rectilinear groove, wherein the jacket is limited to axially move along the curtain cloth reeling drum, and wherein the speed reducing device is connected to an end of the screw rod.

18. The curtain according to claim 1, wherein the rotation driving device actuates the reeling rope device by a transmission shaft.

19. The curtain according to claim 18, wherein the reeling rope device comprises a support, a reeling shaft mounted in the support and driven by the rotation driving device, a stopper formed on the reeling shaft and having an interior surface tightly pressing against the reeling shaft, a reeling rope guiding device mounted beneath the reeling shaft and corresponding to the stopper, and a reeling rope with one end of the reeling rope fixed to the reeling shaft away from the stopper and with another end of the reeling rope extending through reeling rope guiding device and connected to the curtain cloth.

20. The curtain according to claim 19, wherein the stopper is located in a position in front of a position from which the reeling rope of the reeling rope guiding device comes out.

21. The curtain according to claim 20, wherein a distance between the position of the stopper and the position from which the reeling rope of the reeling rope guiding device comes out is not smaller than the diameter of the reeling rope.

22. The curtain according to claim 21, wherein at least one section on the reeling shaft around which the reeling rope is wound has decreasing diameters towards a fixed point of the reeling rope on the reeling shaft, and wherein a diameter of a front reeling shaft of the reeling shaft wound with the reeling rope in the direction of the reeling rope on the fixed point of the reeling shaft is not smaller than that of a rear reeling shaft of the reeling shaft.

23. The curtain according to claim 19, wherein the reverse rotation releasing device comprises a sleeve in communication with the axial hole and a sleeve shaft disposed within the sleeve and connected to the rotary shaft, wherein the transmission shaft is extended through the sleeve shaft, wherein an interior side wall of the sleeve includes a guide groove, wherein a continuous sliding path is formed along a surface of the sleeve shaft, wherein a ball is located between the guide groove and the sliding path, wherein the sliding path comprises one or more groups of left and right sliding paths and an intermediate V-shaped sliding path, wherein in a direction of the left sliding path and the intermediate sliding path, guiding mouths for respective directions to the right sliding path and the left sliding path are provided, wherein in another direction of the right sliding path, a guide mouth for a direction to the intermediate V-shaped sliding path is provided, and wherein a cover is fixed to an exterior opening of the sleeve by a screw.

24. The curtain according to claim 23, wherein a speed reducing device is mounted to the other end of the curtain bracket and connected to the transmission shaft.

25. The curtain according to claim 24, wherein the speed reducing device comprises a box body, a speed shifting mechanism mounted in the box body and connected to the transmission shaft, and a frictional speed reducing mechanism driven by the speed shifting mechanism, wherein the speed shifting mechanism comprises a rotary shaft, a gear coupled to the rotary shaft, and a worm engaged with the gear, wherein output shafts of the worm are mounted in the box body via bearings and connected to the friction speed reducing mechanism, wherein the frictional speed reducing mechanism comprises a rotary base, a friction block swingingly connected to the rotary base, and a circular chamber formed in the box body, and wherein the friction block is positioned in the circular chamber.

26. The curtain according to claim 25, wherein the output shafts on both ends of the worm are connected to the frictional speed reducing mechanisms.

27. The curtain according to claim 26, wherein a spring coil is mounted between the rotary shaft and the gear with an end of the spring coil connected to the rotary shaft or the gear, wherein a winding direction of the spring coil along a connection point end is opposite to a driving rotation direction of the rotation driving device when the end of the spring coil is connected to the rotary shaft, and wherein the winding direction of the spring coil along the connection point end is same as the driving rotation direction of the rotation driving device when the end of the spring coil is connected to the gear.

28. The curtain according to claim 25, further comprising: another speed shifting mechanism and another frictional speed reducing mechanism driven by the other speed shifting mechanism.

29. The curtain according to claim 28, wherein a gear transmission device is connected between the gear and the rotary shaft.

30. The curtain according to claim 25, wherein each bearing is a steel ball mounted between an axial hole and the output shaft of the worm.

31. The curtain according to claim 28, wherein each bearing is a steel ball mounted between an axial hole and the output shaft of the worm.

32. The curtain according to claim 1, wherein both ends of the curtain bracket are provided with the rotation driving device, wherein two sets of reeling rope devices respectively driven by two sets of rotation driving devices and two sets of curtain cloths or shades driven by the two sets of reeling rope devices are mounted on the curtain bracket, wherein the reverse rotation releasing devices are connected to the rotation driving devices, and wherein the two sets of curtain cloths or shades are connected end to end.

33. The curtain according to claim 32, wherein each reverse rotation releasing device comprises a sleeve in communication with the axial hole and a sleeve shaft mounted in the sleeve and connected to the rotary shaft, wherein the transmission shaft is extended through the sleeve shaft, wherein a guide groove is formed in an interior side wall of the sleeve, wherein a continuous path is formed along a surface of the sleeve shaft, wherein a ball is mounted between the guide groove and the sliding path, wherein the sliding path comprises one or more groups of left and right sliding paths and an intermediate V-shaped sliding path, wherein in a direction of the left sliding path and the intermediate sliding path, guiding mouths for respective-direction directions to the right sliding path and the left sliding path are provided, wherein in another direction of the right sliding path, a guide mouth for a direction to the intermediate V-shaped sliding path is provided, and wherein a cover is fixed to an exterior opening of the sleeve by a screw.

34. The curtain according to claim 33, wherein the curtain bracket is provided with a speed reducing device connected to the transmission shaft, wherein the speed reducing device comprises a box body, a speed shifting mechanism mounted in the box body and connected to the transmission shaft, and a frictional speed reducing mechanism driven by the speed shifting mechanism, wherein the speed shifting mechanism comprises a rotary shaft, a gear or a gear train coupled to the rotary shaft, and a worm engaged with the gear or an output gear of the gear train, wherein output shafts of the worm are mounted in the box body via bearings, wherein one of the output shafts of the worm is connected to the frictional speed reducing mechanism, wherein the frictional speed reducing mechanism comprises a rotary base, a friction block swingingly connected to the rotary base, and a circular chamber formed in the box body, and wherein the friction block is positioned in the circular chamber.

35. The curtain according to claim 34, wherein the output shafts at both ends of the worm are connected to the frictional speed reducing mechanism.

36. The curtain according to claim 35, wherein each bearing is a steel ball mounted between an axial hole and the output shaft of the worm.

37. The curtain according to claim 34, wherein a spring coil is mounted between the rotary shaft and the gear with an end of the spring coil connected to the rotary shaft or the gear, wherein a winding direction of the spring coil along the connection point end is opposite to a driving rotation direction of the rotation driving device when the end of the coil is connected to the rotary shaft, and wherein the winding direction of the spring coil along the connection point end is same as the driving rotation direction of the rotation driving device when the end of the spring coil is connected to the gear.

38. The curtain according to claim 33, wherein the sleeve of the reverse rotation releasing device is connected to the curtain bracket by a sleeve box, wherein both ends of the box body of the speed reducing device are provided with fixing hooks, wherein the sleeve box and the pull rope rotary disc box of the rotation driving device corresponding to the fixing hooks are respectively provided with buckles, and wherein the reverse rotation releasing device and the rotation driving device are respectively secured to both ends of the speed reducing device by the fixing hooks and the buckles.

39. The curtain according to claim 37, wherein the sleeve of the reverse rotation releasing device is connected to the curtain bracket by a sleeve box, wherein both ends of the box body of the speed reducing device are provided with fixing hooks, wherein the sleeve box and the pull rope rotary disc box of the rotation driving device corresponding to the fixing hooks are respectively provided with buckles, and wherein the reverse rotation releasing device and the rotation driving device are respectively secured to both ends of the speed reducing device by the fixing hooks and the buckles.

* * * * *